US006529697B1

(12) United States Patent
Burkes et al.

(10) Patent No.: US 6,529,697 B1
(45) Date of Patent: Mar. 4, 2003

(54) METHODS AND APPARATUS FOR CALIBRATING INLINE COLOR LASER PRINTERS

(75) Inventors: Theresa A. Burkes, Meridian, ID (US); George B. Clifton, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 338 days.

(21) Appl. No.: 09/652,609

(22) Filed: Aug. 30, 2000

(51) Int. Cl.[7] ..... G03G 15/00
(52) U.S. Cl. ..... 399/72; 399/60
(58) Field of Search ..... 399/72, 49, 15, 399/18, 60, 43

(56) References Cited

U.S. PATENT DOCUMENTS

| | | | | |
|---|---|---|---|---|
| 5,428,464 A | | 6/1995 | Silverbrook | 358/501 |
| 5,461,470 A | * | 10/1995 | De Cook et al. | 399/288 |
| 5,566,277 A | | 10/1996 | Hideshima et al. | 395/115 |
| 5,973,716 A | | 10/1999 | Morita et al. | 347/233 |
| 6,031,638 A | | 2/2000 | Rao et al. | 358/474 |

FOREIGN PATENT DOCUMENTS

JP 10133977 11/1999

* cited by examiner

*Primary Examiner*—Quana M. Grainger

(57) ABSTRACT

Methods and apparatus for reducing the time required to generate a calibration image product on a transfer medium in an inline imaging device having a plurality of toner stations by simultaneously applying at least two toners to the transfer medium. In one method of the present invention, each toner station is configured to deposit an associated toner onto the transfer medium to thereby generate the calibration product. The method includes the step of depositing a first toner from a first toner station and a second toner from a second toner station onto the transfer medium while moving the transfer medium from a first position relative to the plurality of toner stations to a second position. An apparatus of the present invention includes a scanning section, a plurality of toner stations, a transfer medium, and a calibration image product generator. Each toner station is configured to deposit a dedicated toner onto the transfer medium. The transfer medium is configured to move past the toner stations in serial order, and the scanning section is configured to cause selective deposition of toner associated with a toner station onto the transfer medium. The calibration image product generator is configured to cause the scanning section and the plurality of toner stations to produce a calibration image product on the transfer medium as the transfer medium moves past the toner stations. The calibration image product generator is further configured to cause at least two toner stations to simultaneously deposit toner onto the transfer medium.

15 Claims, 17 Drawing Sheets

METHODS AND APPARATUS FOR CALIBRATING INLINE COLOR LASER PRINTERS

FIELD OF THE INVENTION

This invention pertains to inline color laser imaging devices, as well as electrophotographic development processes, and in particular to methods and apparatus for reducing calibration time in an inline color imaging device.

BACKGROUND OF THE INVENTION

Color printing by an electrophotographic printer is achieved by scanning a digitized image onto a photoconductor. Typically, the scanning is performed with diodes which pulse a beam of energy onto the photoconductor. The diodes can be for example laser diodes or light emitting diodes (LEDs). The photoconductor typically comprises a drum or a belt coated with a photoconductive material capable of retaining localized electrical charges. Each localized area capable of receiving a charge corresponds to a pixel. Each pixel is charged to a base electrical charge, and then is either exposed or not exposed by the laser, as dictated by the digital data used to pulse the laser. Exposing a pixel corresponds to electrically altering (typically discharging) the localized area from the base electrical charge to a different electrical charge. One charge will attract toner, and the other charge will not. In this manner, toner is selectively transferred to the photoconductor. In most electrophotographic printing processes, the exposed (electrically discharged) pixels attract toner onto the photoconductor. This process is known as discharge area development (DAD). However, in some electrophotographic printing processes the toner is attracted to the un-discharged (i.e., charged) area on the photoconductor. This latter type of electrophotographic printing is known as charge-area-development (CAD). For purposes of discussion, it will be assumed that DAD is used, although the present invention is not limited to DAD.

Once the photoconductor has had the desired toner transferred to it, the toner is then transferred to the finished product medium. This transfer can direct, or it can be indirect using an intermediate transfer device. The finished product medium typically comprises a sheet of paper, but can also comprise a transparency. After the toner is transferred to the finished product medium, it is processed to fix the toner to the medium. This last step is normally accomplished by thermally heating the toner to fuse it to the medium, or applying pressure to the toner on the medium. Any residual toner on the photoconductor and/or the intermediate transfer device is removed by a cleaning station, which can comprise either or both mechanical and electrical means for removing the residual toner.

There are a variety of known methods for selectively attracting toner to a photoconductor. Generally, each toner has a known electrical potential affinity. Selected areas of the photoconductor are exposed from a base potential to the potential for the selected toner, and then the photoconductor is exposed to the toner so that the toner is attracted to the selectively exposed areas. This latter step is known as developing the photoconductor. In some processes, after the photoconductor is developed by a first toner, the photoconductor is then recharged to the base potential and subsequently exposed and developed by a second toner. In other processes, the photoconductor is not recharged to the base potential after being exposed and developed by a selected toner. In yet another process, the photoconductor is exposed and developed by a plurality of toners, then recharged, and then exposed and developed by another toner. In certain processes, individual photoconductors are individually developed with a dedicated color, and then the toner is transferred from the various photoconductors to a transfer medium which then transfers the toner to the finished product medium. The selection of the charge-expose-develop process depends on a number of variables, such as the type of toner used and the ultimate quality of the image desired.

Image data for an electrophotographic printer (which will also be known herein as a "laser printer"), including color laser printers, is digital data which is stored in computer memory. The data is stored in a matrix or "raster" which identifies the location and color of each pixel which comprises the overall image. The raster image data can be obtained by scanning an original analog document and digitizing the image into raster data, or by reading an already digitized image file. The former method is more common to photocopiers, while the latter method is more common to printing computer files using a printer. Accordingly, the technology to which the invention described below is applicable to either photocopiers or printers. Recent technology has removed this distinction, such that a single printing apparatus can be used either as a copier, a printer for computer files, or a facsimile machine. In any event, the image to be printed onto tangible media is stored as a digital image file. The digital image data is then used to pulse the beam of a laser in the manner described above so that the image can be reproduced by the electrophotographic printing apparatus. Accordingly, the expression "printer" should not be considered as limiting to a device for printing a file from a computer, but should also include a photocopier capable of printing a digitized image, regardless of the source of the image.

The raster image data file is essentially organized into a two dimensional matrix. The image is digitized into a number of lines. Each line comprises a number of discrete dots or pixels across the line. Each pixel is assigned a binary value relating information pertaining to its color and potentially other attributes, such as density. The combination of lines and pixels makes up the resultant image. The digital image is stored in computer readable memory as a raster image. That is, the image is cataloged by line, and each line is cataloged by each pixel in the line. A computer processor reads the raster image data line by line, and actuates the laser to selectively expose a pixel based on the presence or absence of coloration, and the degree of coloration for the pixel.

The method of transferring the digital raster data to the photoconductor via a laser, lasers or LEDs is known as the image scanning process or the scanning process. The scanning process is performed by a scanning portion or scanning section of the electrophotographic printer. The process of attracting toner to the photoconductor is known as the developing process. The developing process is accomplished by the developer section of the printer. Image quality is dependent on both of these processes. Image quality is thus dependent on both the scanning section of the printer, which transfers the raster data image to the photoconductor, as well as the developer section of the printer, which manages the transfer of the toner to the photoconductor.

A typical in-line color laser printer utilizes a plurality of (typically 4) laser scanners to generate a latent electrostatic image for each color plane to be printed. This allows for four colors to be imaged on a transfer medium and then transferred to the finished product medium. The four color planes typically printed, and which are generally considered as necessary to generate a relatively complete palate of colors, are yellow, magenta, cyan and black. That is, the color printer is typically provided with toners in each of these four colors. These colors will be known herein as the "primary colors". Some printers have the capability of printing one base color on top of another on the same pixel, so as to generate a fuller palate of finished colors. One method to accomplish this is to provide four photoconductors, one for each primary color, used in conjunction with an intermediate transfer belt. This configuration is described more fully below with respect to the prior art apparatus shown in FIG. 1.

In the scanning process, a laser is scanned from one edge of the photoconductor to the opposing edge and is selectively actuated or not actuated on a pixel-by-pixel basis to scan a line of the image onto the photoconductor. The photoconductor advances and the next line of the image is scanned by the laser onto the photoconductor. The side-to-side scanning of each laser is traditionally accomplished using a dedicated multi-faceted rotating polygonal mirror which causes the laser beam to be scanned across the photoconductor at the unique relative lineal position from a first edge to a second edge of the photoconductor. As the mirror rotates to an edge of the polygon between facets, the laser is essentially reset to the first edge of the photoconductor to begin scanning a new line onto the advancing photoconductor.

For color printing, it is important to assure the registration of the different colors. That is, each laser should be aligned with respect to the other lasers such that a given pixel in the raster image is associated with a single common point on the transfer medium, regardless of which laser is used to identify the point. A registration which is "off" will result in a blurry image, or an image with colors not representative of the raster image. Registration is thus dependent on aligning all of the lasers in a laser printer with respect to one another, a process known as calibration. Each laser and its associated components (i.e., rotating mirror, optical elements, and deflector mirror) is typically mounted in a precision housing to keep the components in relative fixed position with respect to one another. Assuring registration of the lasers requires aligning the four housings within the printer itself. As environmental conditions within the printer change (e.g., temperature), this alignment can change. Mechanical vibration or shock to the printer can also allows the lasers to become misaligned.

Since only partial calibration of the laser beams with respect to one another can be achieve by aligning the housings which contain the scanning assemblies, in-line color printers are typically also provided with a calibration system to allow for factory and ex-factory calibration of the lasers. One component of the calibration system is color plane sensors to sense color plane alignment. Sensors are provided to detect shifts in color planes in both the side-to-side scanning direction (the "scan" direction), as well as in the direction of advance of the transfer medium (i.e., the "process" direction). The sensors can provide a feedback to the scanning system and corrections can be made to reposition the laser beam using various known electrical and mechanical methods.

In addition to color plane alignment, color density is another criteria to which a color imaging device can be calibrated. That is, to faithfully reproduce an original image, the density of the toners as applied to the photoconductor should be applied in a manner such that the brightness, contrast and gamma (color density) of the colors appear the same in the generated image as they appear in the original image. This can be achieved by one or more of the processes of varying the quantity of toner applied to the photoconductors, by varying the combination of toners, or by varying the pixel spacing of the toner or toners as they are applied to the photoconductor.

In addition to color registration and density, another characteristic that can be important to achieving a high quality resultant image is faithful reproduction of the spectrum of the colors which are in the original image. That is, a color characterized by a given wavelength in the original image should preferably be reproduced to essentially the same wavelength in the finished image. Since the toners themselves can affect the spectral aspects of the finished product, it is desirable to provide a mechanism to compensate for toner variations, as well as other variables within the imaging apparatus which can affect spectral aspects of the final image. Such a mechanism can attempt to correct spectral variances by varying the mix of toners applied to a pixel, as well as the quantity of each toner applied.

To determine when a color density or spectrum is accurately imaged on the transfer medium, the calibration system can be further provided with color density sensors and color spectrum sensors which can detect the characteristics of a color (e.g., brightness, contract, gamma, and spectral characteristics). Preferably, the calibration sensors are configured to sense the colors deposited on the intermediate transfer medium by the photoconductors (in an inline color printer), rather than on the final printed image, since the medium on which the toner is ultimately deposited can have attributes affecting the color properties.

In order to generate an image on the transfer medium which has known properties against which a standard can be compared, most color imaging devices are provided with a calibration image of known qualities. The qualities can comprise images of known geometric patters (e.g., circles, squares, etc.), color types (e.g., a color of a known wavelength, a color of a known intensity, etc.), and color proximities (e.g., blue adjacent to red). The calibration image is typically stored in computer readable memory which is preferably resident within the imaging device itself. When calibration is to be performed, either automatically or as directed by a user, the color imaging device generates the calibration image on the intermediate transfer medium to produce a calibration product. The calibration product is then moved past the calibration sensors to detect the applied colors. The sensors send output signals to a processing unit (preferably resident within the imaging apparatus). The output signals from the calibration sensors can be stored temporarily in computer resident memory. The output signals are then compared to the calibration image on a selected pixel-by-pixel basis to determine if the calibration product varies from the calibration image, and if so, by how much.

The processor can be further provided with an algorithm to determine what correction(s), if any, need to be made to bring the calibration product into conformance with the calibration image. The corrections can include for example adjusting timing of the activation of the lasers to affect the relative positions of the application of one toner with respect to another, adjusting the intensity of the lasers to affect the amount of toner deposited on a photoconductor (and hence onto the transfer medium), adjusting the positions of energy beams from the lasers directed onto the photoconductors, and adjusting the rotational speeds of the individual photoconductors. Other adjustments are also possible. After adjustments are made, it can be preferable to generate another calibration product to determine whether or not the adjustments have brought the various components of the imaging apparatus into conformance with the calibration image.

The prior art methods for generating a calibration product are configured such that as the transfer medium moves past the various optical photoconductors ("OPC") in a direction from the first OPC to the last OPC, a first toner is applied to the transfer medium by a first OPC most distal from the calibration sensor, a second toner is then applied to the transfer medium by a second OPC, and so on until the last toner is applied to the transfer medium. The calibration product is then passed by the calibration sensors. It is thus obvious that the overall calibration time includes the time between the initial application of the first toner to the transfer medium, and the time the first-applied toner passes by the first calibration sensor. Since calibration can be automatically invoked each time the imaging apparatus is put into service, it is apparent that the calibration time can affect the availability of the imaging apparatus until the calibration process is completed. It is therefore desirable to find a way to reduce the calibration time for inline color imaging devices to thus improve the availability of the device to users.

FIG. 1A depicts a schematic side elevation diagram of a four laser color electrophotographic imaging apparatus ("printer") 10 which can be used to implement the prior art calibration method. The printer 10 comprises a scanning section 12 and a photoconductor section 14, also known as the developing section. The scanning section, or "exposure section" 12 comprises a plurality of lasers, typically one laser for each photoconductor station. The coherent beams of energy from each laser are directed to a dedicated photoconductor in the developing section via a rotating reflective mirror and other optical components. The photoconductor section 14 shown in FIG. 1A comprises four optical photoconductors ("OPCs") 16, 18, 20 and 22. In the configuration shown, each OPC is provided rotating drum which subsequently transfers toner from the OPC to the transfer medium, belt 24. In an alternate embodiment, the toner can be applied directly to the transfer medium 24 without the use of the four individual OPCs. The belt 24 rotates in the direction "A" to move toner deposited on the belt past a calibration sensor 28. The belt is supported by rollers 26. In a printing mode, a sheet of finished product medium "M", for example a sheet of paper, is passed in close proximity to the belt 24. A toner transfer module 42, typically an electrostatic charge unit, transfers toner from the belt 24 to the medium "M". The toner is then fused to the medium at the fusing station 44. Any residual toner remaining on the belt 24 is removed by the cleaning station 40 before the belt returns to the OPC section 14.

The printer 10 further comprises a processing unit 30 which controls the discharge of the lasers in the exposure section 12 to selectively expose each OPC in the exposure section 14. The selective exposure is generated in response to a digital file version of an image to be produced collectively by the four colors. The processing unit 30 is in electrical signal communication with a computer readable memory 32. The computer readable memory 30 is provided with a digital file version 34 of the calibration image, and is further provided with a calibration product generation algorithm 46. The calibration product generation algorithm comprises a series of steps which can be executed by the processor 30 to direct the scanning section 12 to generate the calibration image product on the transfer belt 24.

FIGS. 2A through 2D depict the calibration product generation method of the prior art. The printing apparatus 10 of FIG. 1A is shown in each figure in simplified form. In the prior art method, the toner most removed from the calibration sensor 28 is applied to the transfer belt 24 first, as shown in FIG. 2A. This toner is depicted as T4, applied by OPC16. Following the application of toner T4 to the transfer belt, the toner second-most removed from the calibration sensor 28 is applied. This is depicted in FIG. 2B wherein toner T3 is applied by OPC 18 after toner T4 has passed the OPC. The next prior art calibration step is shown in FIG. 2C, wherein toner T2 is applied following the application of toner T3. The final step is shown in FIG. 2D, wherein the toner T1 nearest the calibration sensor 28 is applied by OPC 22 after the other toners T4, T3 and T2 have passed by the OPC.

As is apparent from FIG. 2C, at this stage in the calibration product generation process the calibration sensor 28 can begin detecting the calibration image product. It is also apparent from FIG. 2C that the time between the initiation of the calibration product generation and the sensing of the first portion of the calibration product is the time it takes the belt 24 to travel from point P1 at OPC 16 to the calibration sensor 28. During this interval the printer is unavailable to print jobs as requested by a user. It is thus desirable to find a way to reduce the time between initiation of calibration product image generation and first sensing of the calibration product.

SUMMARY OF THE INVENTION

The invention includes methods and apparatus for reducing the time required to generate a calibration image product on a transfer medium in an inline imaging device having a plurality of toner stations by simultaneously applying at least two toners to the transfer medium.

In a first embodiment of the present invention, a method for generating a calibration product for an image producing device having a plurality of toner stations and a transfer medium is disclosed. Each toner station is configured to deposit an associated toner onto the transfer medium to thereby generate the calibration product. The method includes the step of simultaneously depositing a first toner from a first toner station and a second toner from a second toner station onto the transfer medium while moving the transfer medium from a first position relative to the plurality of toner stations to a second position. The method can further include the step of simultaneously depositing a third toner from a third toner station onto the transfer medium while moving the transfer medium from the first position relative to the plurality of toner stations to the second position.

In a second embodiment of the present invention, a first toner from a first toner station is deposited onto the transfer medium while moving the transfer medium from a first position relative to the plurality of toner stations to a second position. A second toner from a second toner station is then deposited onto the transfer medium while continuing to deposit the first toner onto the transfer medium while moving the transfer medium from the second position to a third position. The method can further include the step of selecting the first toner to be applied to the transfer medium as a function of a length of a portion of the calibration product to be defined by the first toner and the distance between the first toner station and the second toner station.

An apparatus in accordance with the present invention includes a scanning section, a plurality of toner stations, a transfer medium, and a calibration image product generator. Each toner station is configured to deposit a dedicated toner onto the transfer medium. The transfer medium is configured to move past the toner stations in serial order, and the scanning section is configured to cause selective deposition of toner associated with a toner station onto the transfer medium. The calibration image product generator is configured to cause the scanning section and the plurality of toner stations to produce a calibration image product on the transfer medium as the transfer medium moves past the toner stations. The calibration image product generator is further configured to cause at least two toner stations to simultaneously deposit toner onto the transfer medium.

The apparatus can further include a processor in signal communication with the scanning section, and a computer readable memory accessible by the processor. The calibration image product generator comprises a series of computer executable steps stored in the computer readable memory, the computer executable steps being configured to generate the calibration image product.

DETAILED DESCRIPTION OF THE INVENTION

Figure 1A:
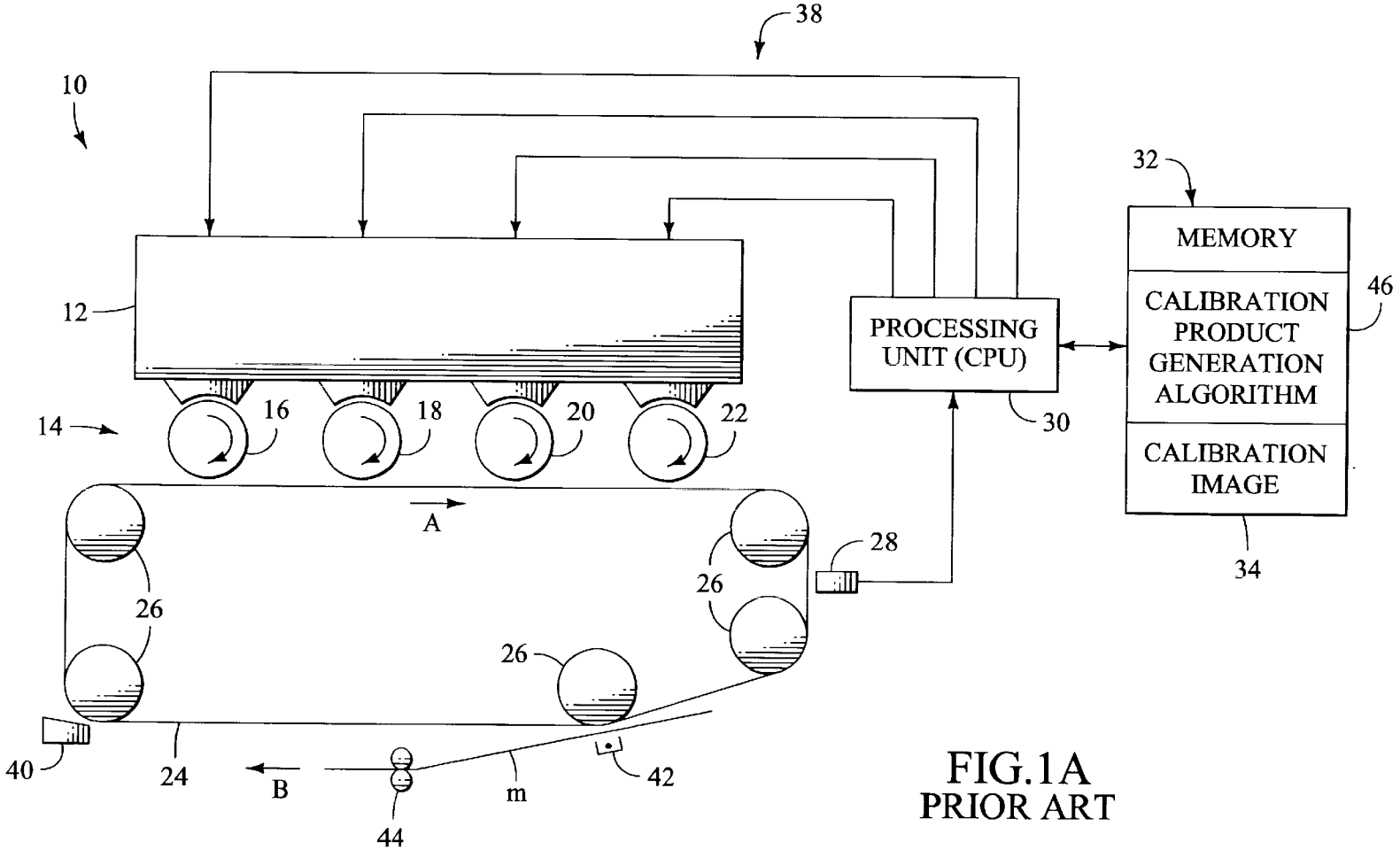
FIG.1A PRIOR ART
FIG. 1A is a side elevation schematic of a prior art imaging device having a prior art calibration image product generating algorithm.

The invention includes methods and apparatus for reducing the time required to generate a calibration image product on a transfer medium in an inline imaging device having a plurality of toner stations by simultaneously applying at least two toners to the transfer medium. Further, the order of application of the toners to the transfer medium can be selected such that the time required for the first portion of the calibration product to reach the calibration sensor is shortened over the prior art methods.

The apparatus of the present invention is described herein as an imaging device, and particularly an inline imaging device. By "inline" we mean that a transfer medium in the imaging device is passed by a plurality of developer stations or "toner stations" in serial order so that toner can be applied to the transfer medium. The transfer medium can then move the toner deposited thereon to a transfer station where it can be transferred to a finished product medium, such as a sheet of paper. The transfer medium can also move the deposited toner past a calibration sensor or sensors so that the pattern of the deposition of toner on the transfer medium can be detected to determine if the deposition conforms to the desired composition, as established by a calibration image. One example of an inline imaging device which is within the scope of the present invention is a color laser printer. Another example is a color photocopier. However, the invention should not be considered as limited to these examples, but is understood in include all apparatus for generating an image using two or more toners.

Methods for comparing a calibration image product to a calibration image are well known in the art, and will not be discussed further herein. Further, the methods and apparatus for making adjustments to an inline imaging device based on a comparison of the calibration product and the calibration image are well known in the art and need not be discussed or described further.

In one embodiment of the present invention, a method for generating a calibration product for an image producing device having a plurality of toner stations and a transfer medium is disclosed. Each toner station is configured to deposit an associated toner onto the transfer medium to thereby generate the calibration product. The method includes the step of simultaneously depositing a first toner from a first toner station and a second toner from a second toner station onto the transfer medium while moving the transfer medium from a first position relative to the plurality of toner stations to a second position. The method can further include the step of simultaneously depositing additional toners from additional toner stations onto the transfer medium while moving the transfer medium from one position relative to the toner stations to another position.

An apparatus in accordance with the present invention includes a scanning section, a plurality of toner stations, a transfer medium, and a calibration image product generator. Each toner station is configured to deposit a dedicated toner onto the transfer medium. The transfer medium is configured to move past the toner stations in serial order, and the scanning section is configured to cause selective deposition of toner associated with a toner station onto the transfer medium. The calibration image product generator is configured to cause the scanning section and the plurality of toner stations to produce a calibration image product on the transfer medium as the transfer medium moves past the toner stations. The calibration image product generator is further configured to cause at least two toner stations to simultaneously deposit toner onto the transfer medium.

These and other methods and apparatus in accordance with the present invention will now be more fully described.

Figure 1B:
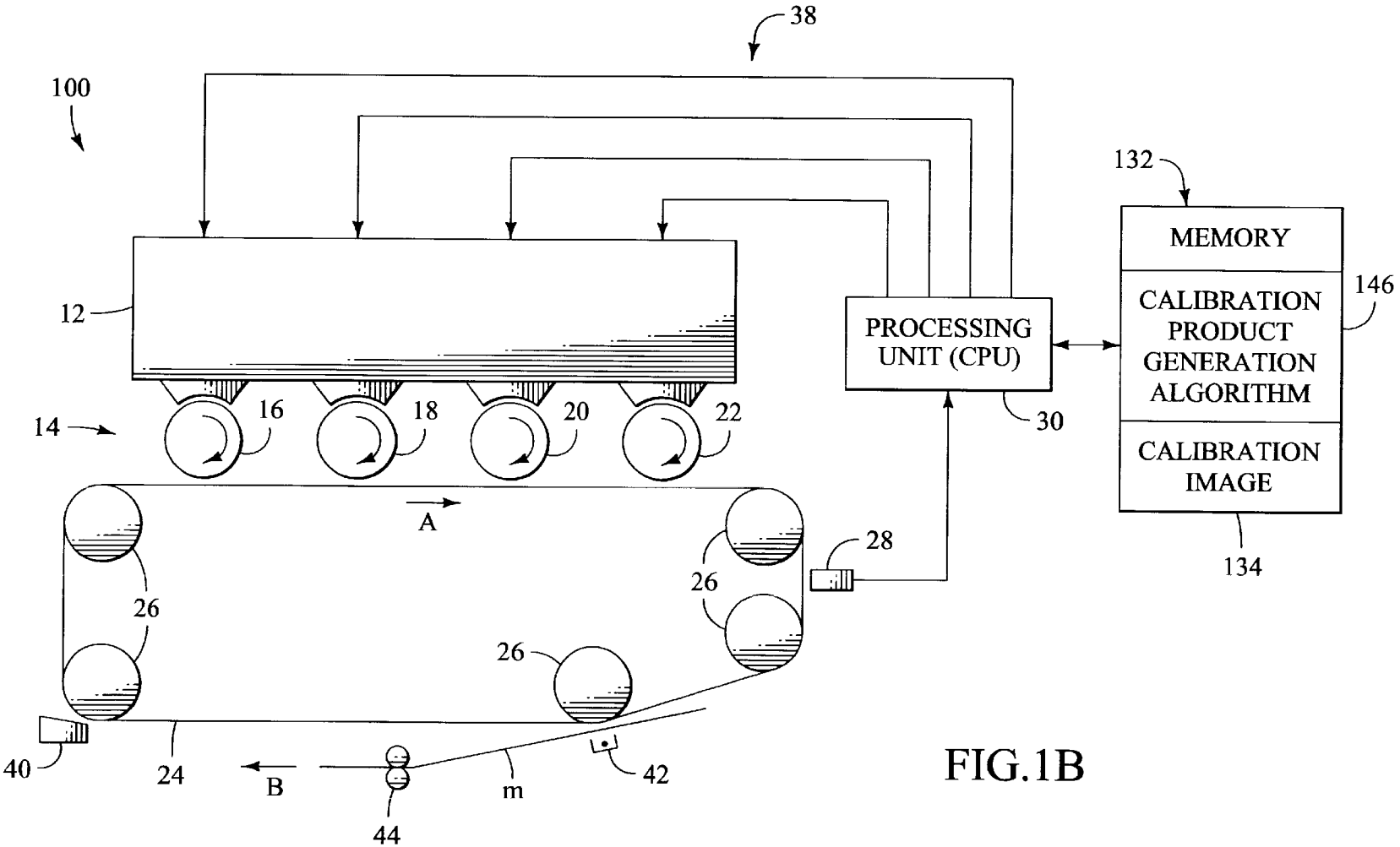
FIG. 1B is a side elevation schematic of an imaging device having a calibration image product generating algorithm in accordance with the present invention.

With reference to FIG. 1B, an image producing device 100 in accordance with the present invention is shown. The operation of the apparatus 100 is similar to that described above with respect to the prior art apparatus 10. However, the apparatus 100 includes modified computer readable memory 132 having a calibration image 134 which can be different than the calibration image of the prior art, and a calibration product generation algorithm 146 which is different than the calibration product generation algorithm of the prior art. The calibration product generation algorithm 146 causes the scanner section 12 and the developer section 14, via the processing unit 30, to generate a calibration image product based on the calibration image 134 in a manner in accordance with the present invention. The calibration product generation algorithm 146 in conjunction with the processing unit 30 can be considered as a calibration product image generator. The developer section 14 can be considered as a calibration product image producer.

Turning now to FIGS. 3A through 3E, a first embodiment of a method in accordance with the present invention is illustrated in sequential steps. FIGS. 3A through 3E depict a simplified side view of the apparatus 100 of FIG. 1A, and show how toner from the developing section 14 can be applied to the transfer medium 24, shown here as a belt, and moved towards the calibration sensor 28. The developer stations or toner stations 16, 18, 20 and 22 are shown as being optical photoconductors (OPCs), which each have as an intermediate transfer medium a rotating drum which transfers toner from a toner hopper (not shown) to the transfer belt 24. The toner section 14 can alternately be configured to apply toner directly to the transfer medium 24 from the toner hoppers. While the transfer medium is shown as a rotating belt, it can also comprise other configurations, such as a rotating drum. In one embodiment, the transfer medium is replaced with the final image medium m, and the individual toner stations 16, 18, 20 and 22 deposit toner directly to the image medium, which is then passed by the calibration sensor 28. The scanning section includes scanning lasers and optical components (not shown) to allow the lasers to selectively expose the various OPCs in accordance with the calibration product generation algorithm 146 of FIG. 1B.

A completed calibration image product can consist of a plurality of toners deposited adjacent to one another on the transfer medium. Turning briefly to FIG. 3E, a completed calibration image product consisting of toners T1 through T4 is shown as deposited on the transfer belt 24, and moving in direction "A" towards the calibration sensor 28. It should be observed that each section of deposited toner defines a length along the transfer belt. For purposes of the discussion below, we will define the lengths of the various toner segments T1 through T4 respectively as "T1, T2, T3, and T4". It should be clear from the context whether the toner itself is being referred to, or the length of the toner segment.

Figure 3A:
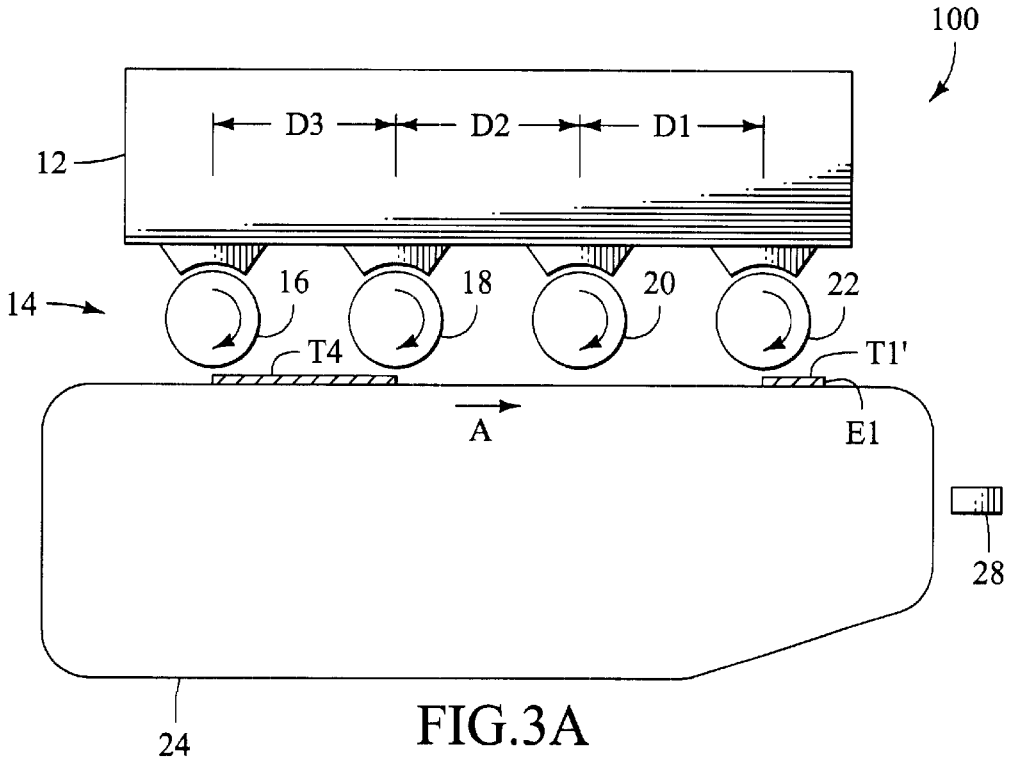
FIGS. 3A through 3E are schematic diagrams depicting one method for generating a calibration product image in accordance with the present invention using the imaging device of FIG. 1B.

Turning now to FIG. 3A, it is seen that the toner stations are separated from one another, and define distances there between. The distance between toner station 22 (associated with toner T1) and adjacent toner station 20 (associated with toner T2) is D1; the distance between toner station 20 and adjacent toner station 18 (associated with toner T3) is D2; and the distance between toner station 18 and adjacent toner station 16 (associated with toner T4) is D4. As will become apparent in the following discussion, the order in which toners are individually and simultaneously applied to the transfer medium 24 will depend in certain instances on the dimensions D1 through D3, and the lengths of the toner segments T1 through T4. In the following discussion we will at times refer to a "first toner" applied to the transfer medium, a "second toner applied", and so on. However, this should in no way be understood as associating the "first", "second", and so on toners with any particular toner identification T1 through T4.

FIGS. 3A through 3E depict an implementation of a method of the present invention wherein each of the toner segment lengths T1 through T4 are longer than the individual distances D1 through D3. In this instance, since the toner paths to be applied are longer than the distances between toner stations, a method to effectively "stretch out" the transfer medium between toner stations is employed to provide room for each toner segment. This is accomplished by initially applying toner T1 to the transfer medium using the toner station nearest the sensor 28. As the applied toner T1 moves towards the sensor, a point is reached where the remaining length of the toner path T1 is equal to the distance D1 between toner station 22 and toner station 20. At this point, toner station 20 can begin depositing toner T2 onto the transfer belt without concern that it will overlap the end of the toner segment T1. Also at this point, both toners T1 and T2 are applied simultaneously to the transfer belt 24. This is illustrated by a comparison of FIGS. 3A and 3B.

Figure 3B:
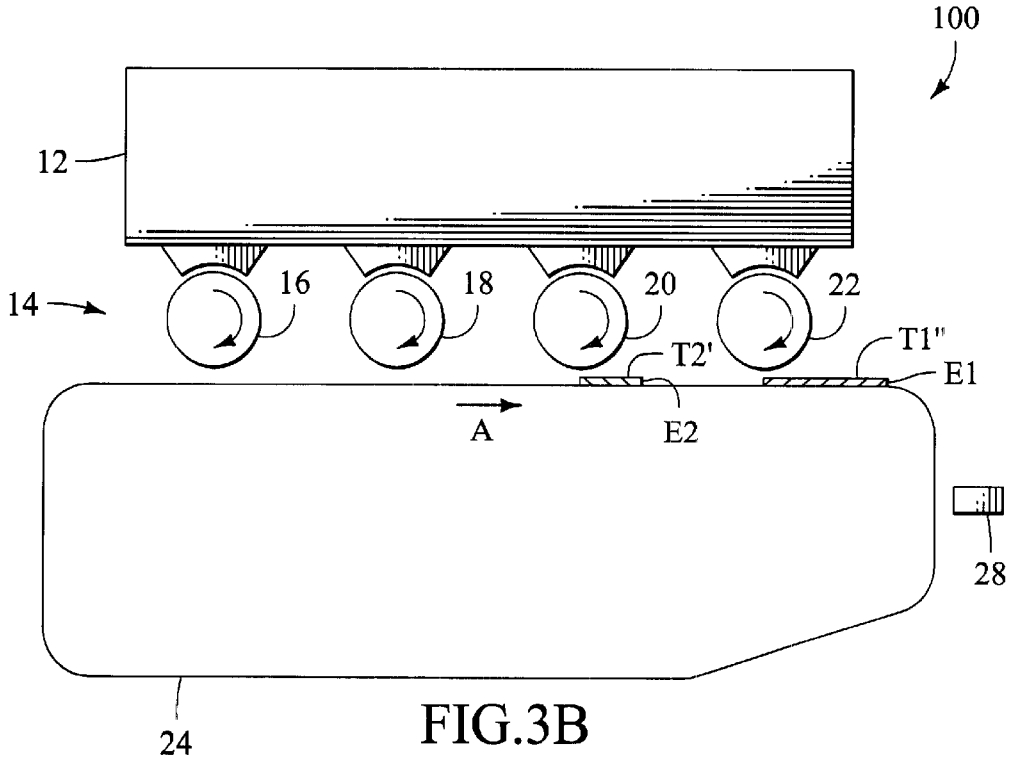

In FIG. 3A, toner station 22 has deposited a partial path T1' of toner T1 to the transfer belt. In FIG. 3B toner station 22 has applied a total path T1" thus far of toner T1, and toner station 20 has deposited a partial path T2' of toner T2. It is evident that the distance between the leading edge E1 of toner T1 and the leading edge E2 of toner T2 defines the overall maximum possible length of toner path T1. (This assumes that toner T1 will not be overlaid over toner T2.) It is also evident from FIG. 3B that toner from both toner stations 20 and 22 is being deposited simultaneously on the transfer belt 24.

Figure 3C:
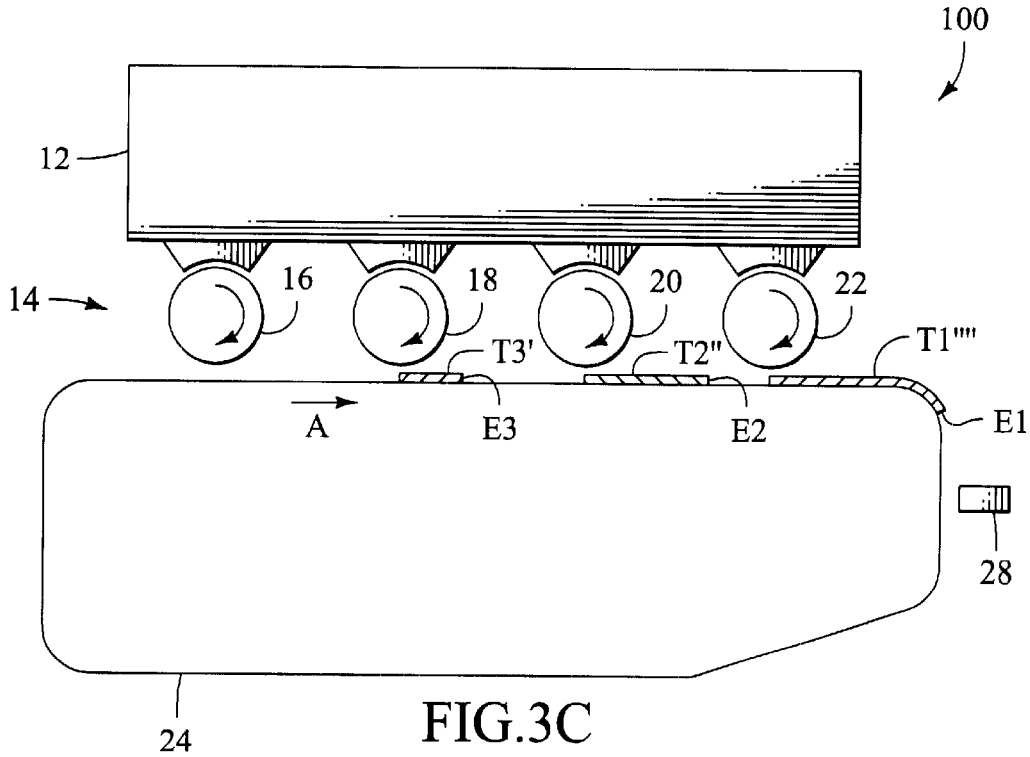

Turning to FIG. 3C, toner path lengths T1"' and T2" have now been applied to the transfer medium 24, and the third toner T3 is now being applied by the toner station 18. A partial path T3' of toner T3 has been applied as shown. As with toner T1 in FIG. 3B, it is evident in FIG. 3C that the total path length of toner T2 is limited to the distance between leading edge E2 of toner T2 and the leading edge E3 of toner T3, again assuming that toner T2 will not be overlaid on toner T3. Also evident from FIG. 3C is that toners T1, T2 and T3 are all being applied simultaneously to the transfer medium 24.

Figure 3D:
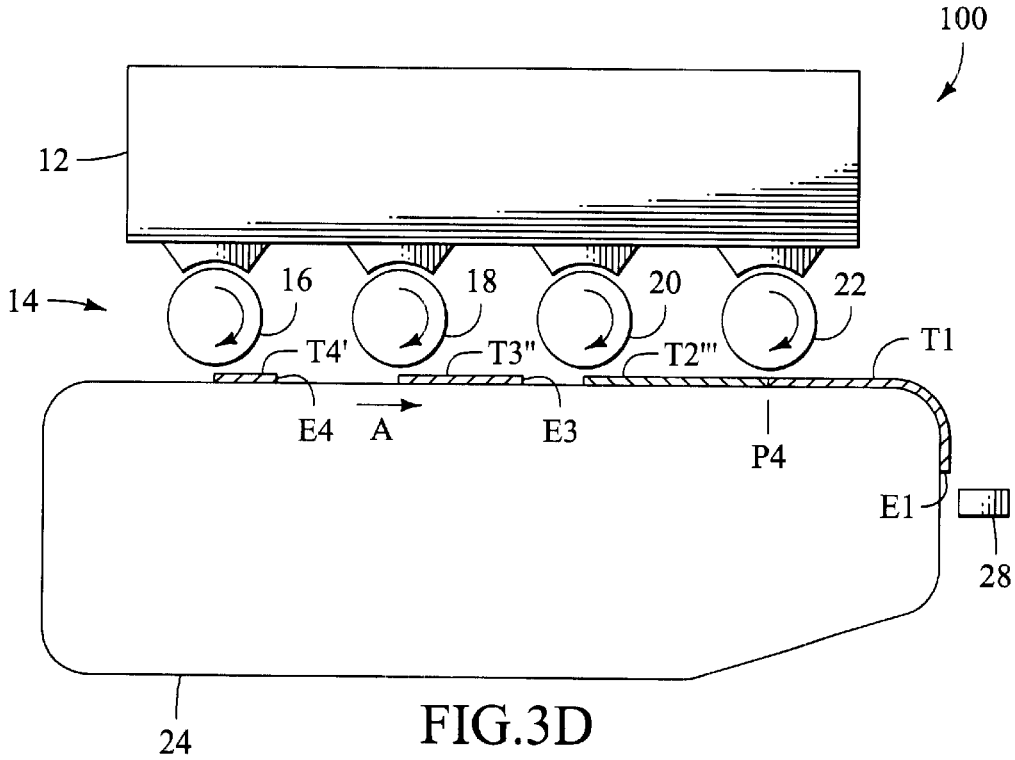
Figure 3E:
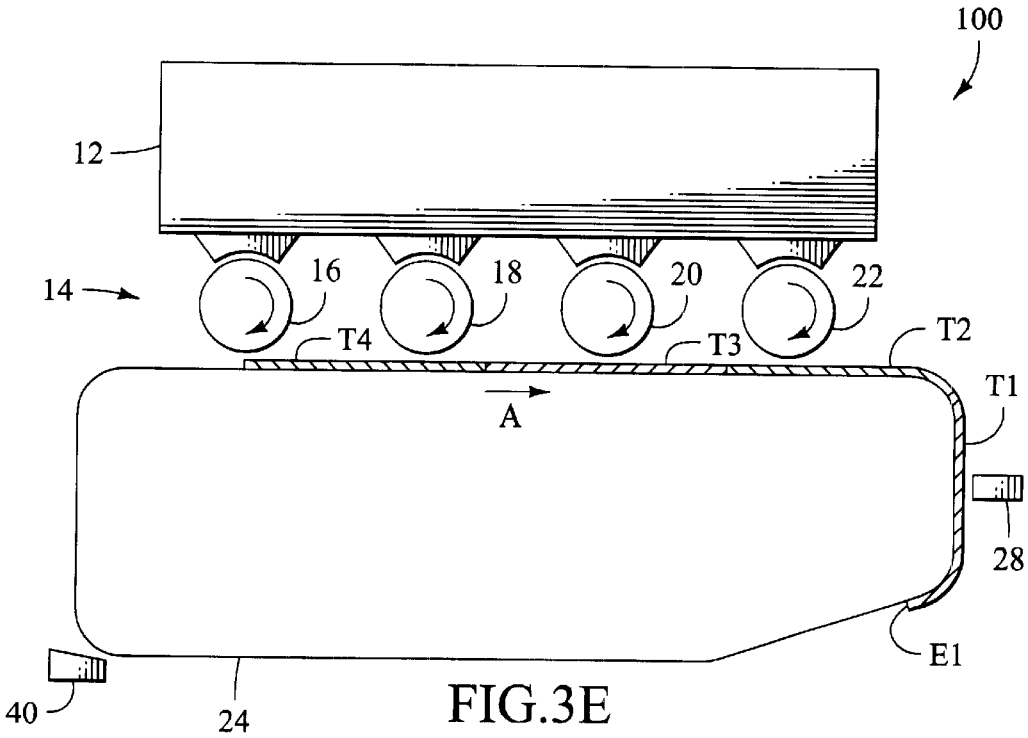

FIG. 3D shows the stage in the calibration image product generation process where toner T1 has now been fully applied to the transfer belt 24. As shown, the trailing edge of toner path T1 butts up against the leading edge of toner path T2. At this point, and assuming toner T1 will not be overlaid over toner T2, the application of toner T1 by toner station 22 is terminated. However, toner T2 and T3 are still being deposited onto the transfer belt 24, as indicated by partial respective toner paths T2"' and T3". Further, a fourth toner, T4, is now also being applied to the transfer belt 24 by toner station 16, and has been applied for a partial path length of T4'. It can be seen that the overall path length of toner T3 is limited to the distance between leading edge E3 of toner T3, and leading edge E4 of toner T4. At the stage depicted in FIG. 3D, toners T2, T3 and T4 are all being applied simultaneously to the transfer medium 24.

Turning now to FIG. 3E, the stage in the calibration product generation method is depicted wherein all four toners, T1, T2, T3 and T4 have been fully applied to the transfer medium 24. The toners can now all be moved past the calibration sensor 28, and the calibration product detected and compared with the digitized calibration image 134 stored in computer memory 132 (FIG. 1B). The correction of the calibration product and the calibration image, and any resulting calibrations made to the imaging device 100, can be performed by the processor 30. As the transfer medium 24 moves the calibration product past the sensor 28 and back towards the developer section 14, a cleaning station 40 can remove the toner from the transfer belt.

Figure 2A:
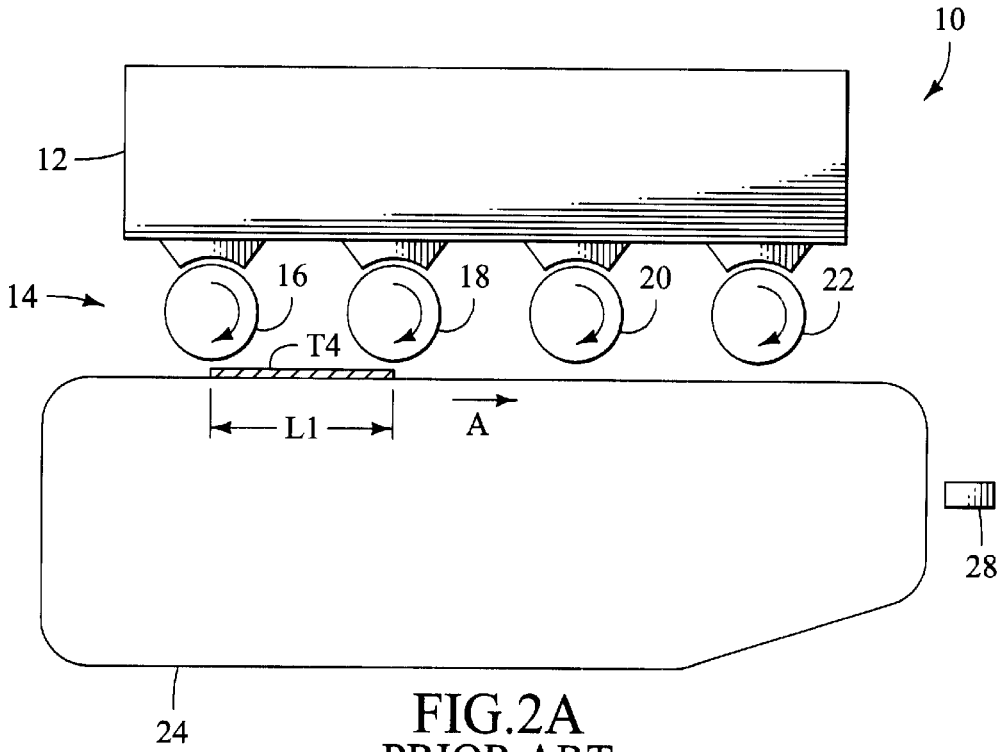
FIG.2A PRIOR ART
FIGS. 2A through 2D are schematic diagrams depicting the prior art method for generating a calibration product image using the imaging device of FIG. 1A.
Figure 2B:
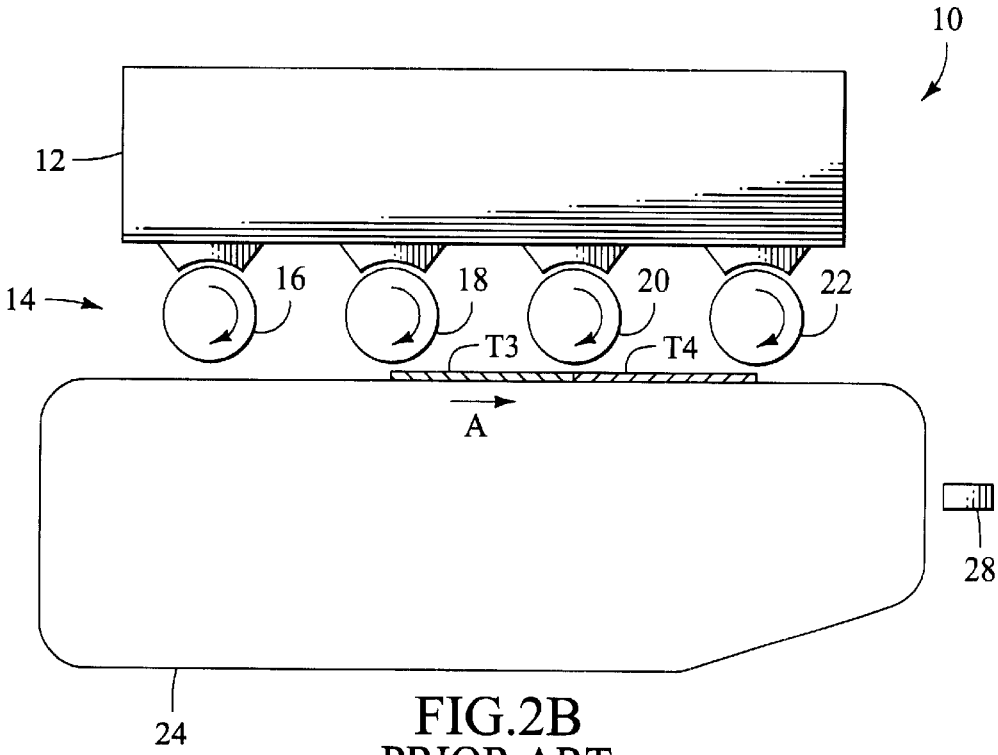
FIG.2B PRIOR ART
Figure 2C:
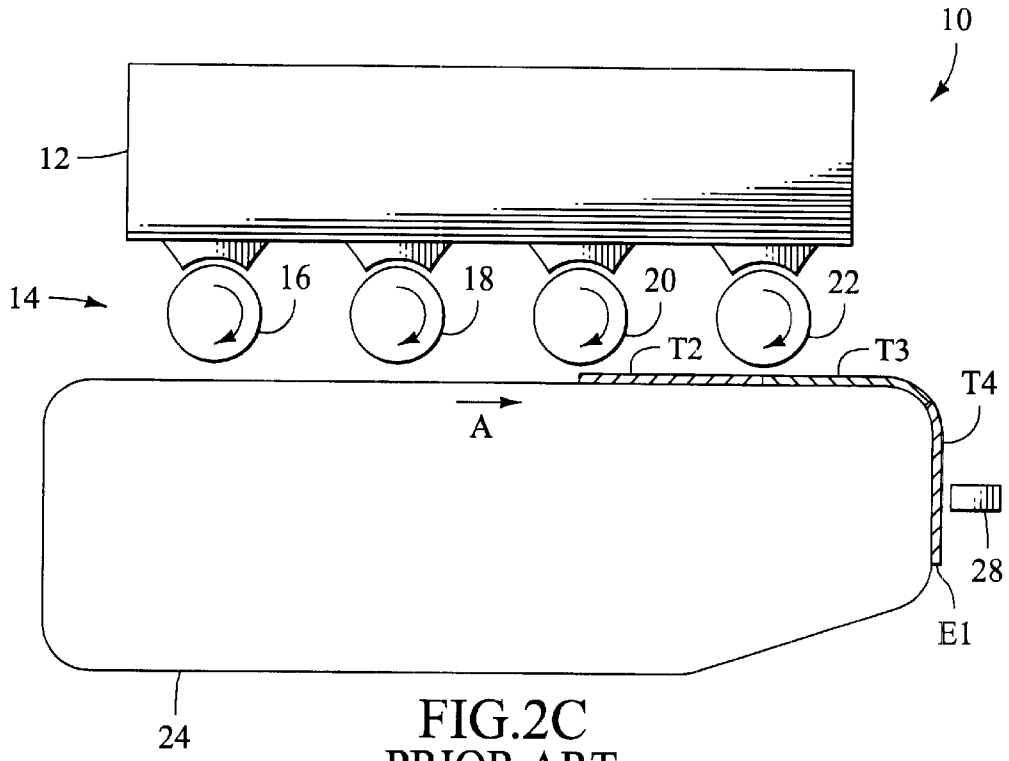
FIG.2C PRIOR ART
Figure 2D:
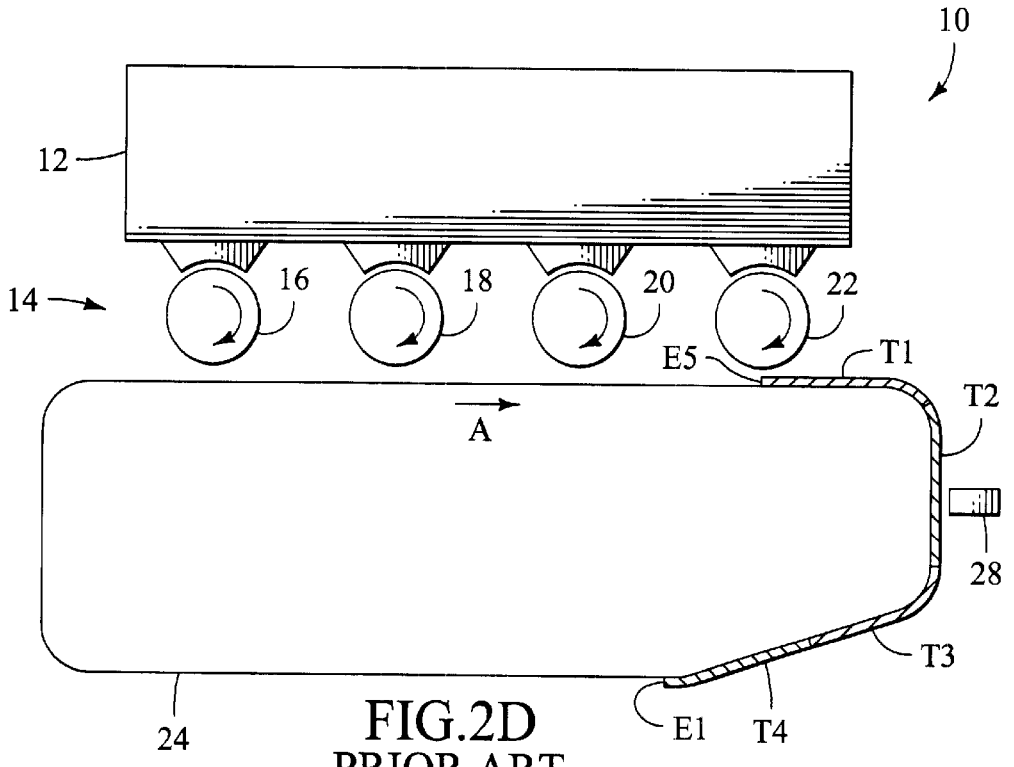
FIG.2D PRIOR ART

FIG. 3D illustrates the benefit of the present invention. The leading edge E1 of the first-applied toner T1 is now presented to the calibration sensor 28, so that the calibration process can begin. A quick review of FIGS. 3A through 3D show that the leading edge of toner T1 has only had to travel from point P4 where the application of the toner first began to the point in front of the sensor 28. This should be compared to the prior art method shown in FIG. 2C, wherein the leading edge E1 of the first-applied toner T4 has had to travel all the way from point P1 at OPC 16 to the sensor 28 before the calibration process can begin. Thus, the method of the present invention has effectively shortened the travel path of the first leading edge of toner by the distance between the first OPC and the last OPC, with a concomitant savings in time. This allows the calibration process to begin much sooner than the prior art method. As also indicated by FIGS. 3D and 3E, sensing of the calibration image product by the calibration sensor 28 can begin well before the complete calibration product is produced.

A second embodiment of the present invention is illustrated in FIGS. 4A through 4G. In this embodiment it is assumed that the length of each toner path T1 through T3 is shorter than the distance between the respective toner station and its next adjacent toner station, the next adjacent toner station being the toner station in a direction opposite to the direction of travel "A" of the transfer medium. This scenario is just the opposite of the embodiment depicted in FIGS. 3A through 3E. In the embodiment shown in FIGS. 3A through 3E the staging of deposition of toners was from right to left (i.e., in a direction opposite to the direction of travel "A" of the transfer medium). However, in the embodiment depicted in FIGS. 4A through 4G, the deposition sequence will be from left to right (i.e., in the same direction as the direction of travel "A" of the transfer medium). This "left-to-right" deposition sequence allows the toners to be "compressed" onto the transfer medium, whereas the "right-to-left" order allowed the toner deposition to be "stretched-out" on the transfer medium. This will become evident in the following discussion.

The embodiment depicted in FIGS. 4A through 4G assumes that no toner path overlays the adjacent toner path. However, as will be discussed later, toner overlay can be accommodated within the scope of the present invention. The image producing device 100 of FIGS. 4A through 4G operates in the same manner as the device 100 of FIGS. 3A through 3E, except for the toner deposition sequence, which will now be described.

Figure 4A:
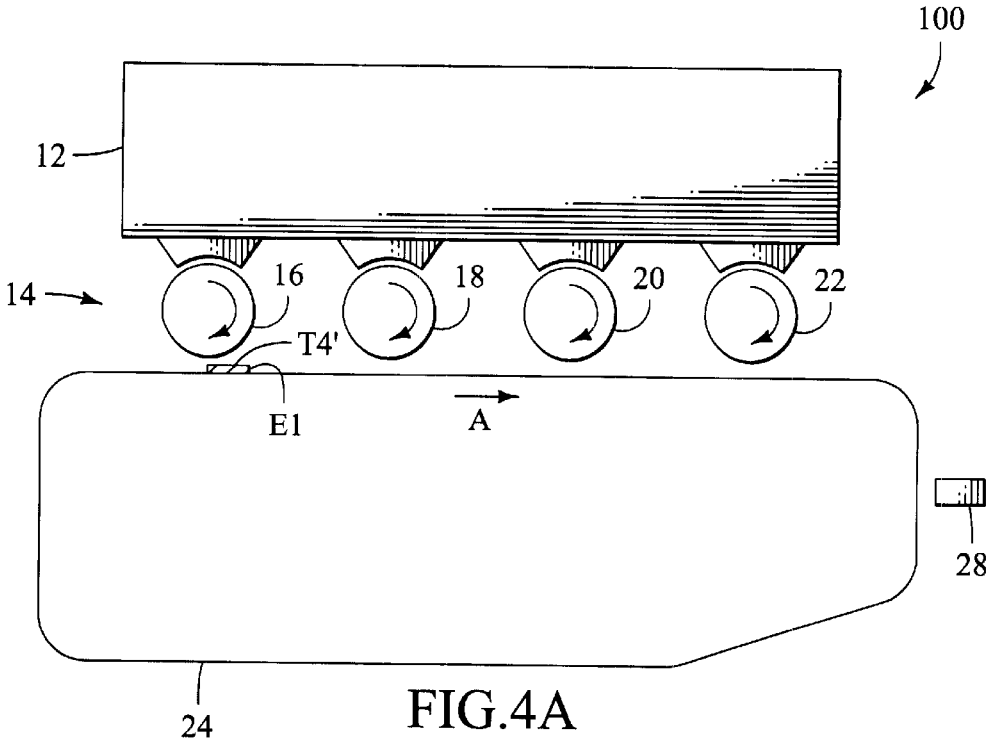
FIGS. 4A through 4G are schematic diagrams depicting another method for generating a calibration product image in accordance with the present invention using the imaging device of FIG. 1B.
Figure 4B:
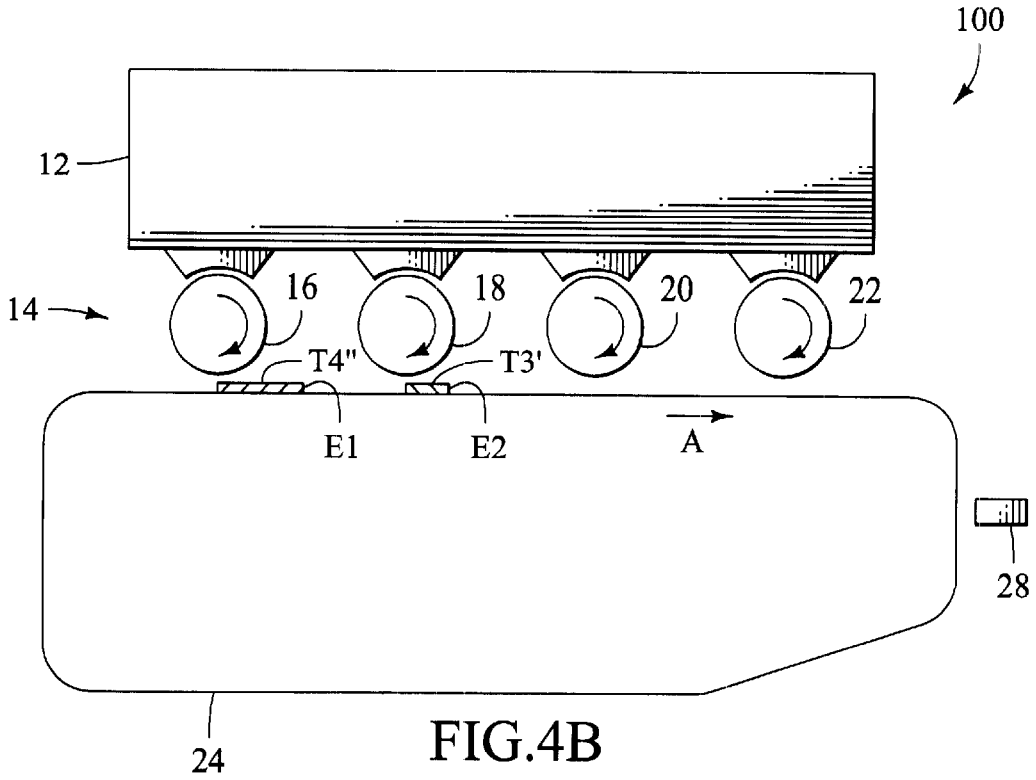
Figure 4C:
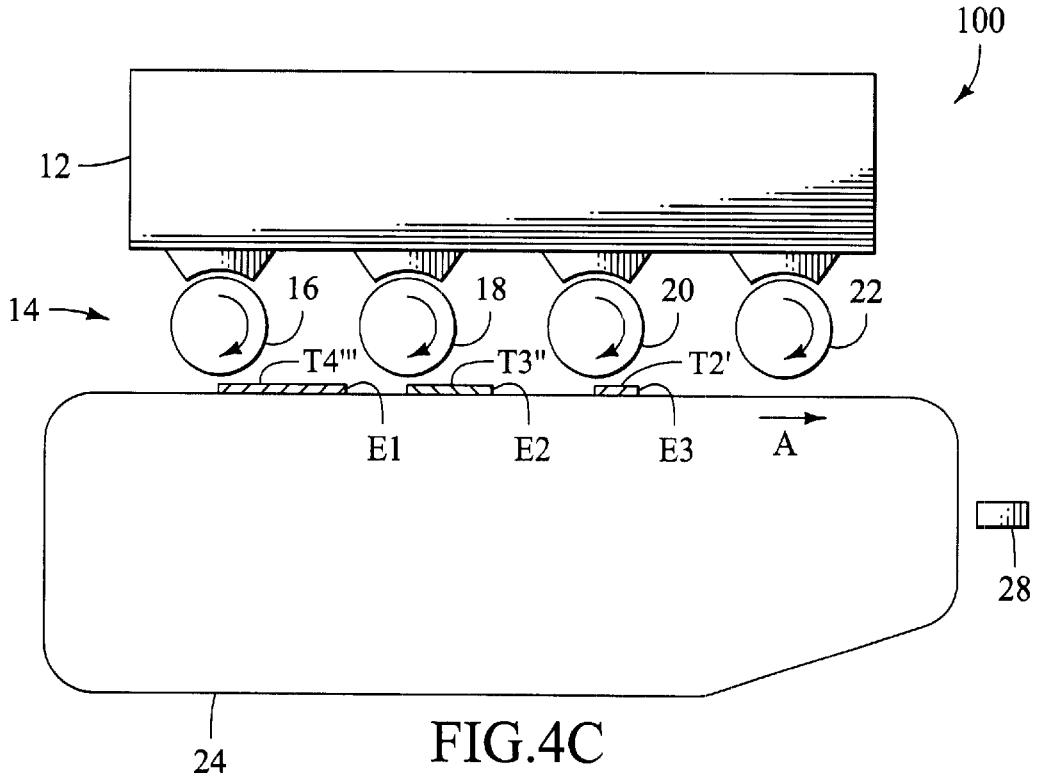

Turning to FIG. 4A, the process of generating the calibration image product is begun at toner station 16, where a portion T4' of toner T4 is deposited onto the transfer medium 24. Toner T4 is applied until the distance from the leading edge E1 of toner path T4' to the toner station 18 is equal to the length of the toner path for toner T3. Turning to FIG. 4B, toner T3 is now being applied to the transfer medium simultaneously with the application of toner T4. The total length of the toner path of toner T3 will be the distance from the leading edge E2 of toner path T3' to the leading edge E1 of toner path T4". As the transfer medium moves towards the calibration sensor 28 in direction "A", the point shown in FIG. 4C is reached where toner T3 is also being applied to the transfer medium 24, simultaneous with the application of toners T3 and T4. As with the toners T4 and T3, the total path of toner T2 will be the distance between the leading edge E3 of toner path T2', and the leading edge E2 of toner path T3". At this point toner T4 has been deposited on the transfer medium 24 for a partial path length of T4"'.

Figure 4D:
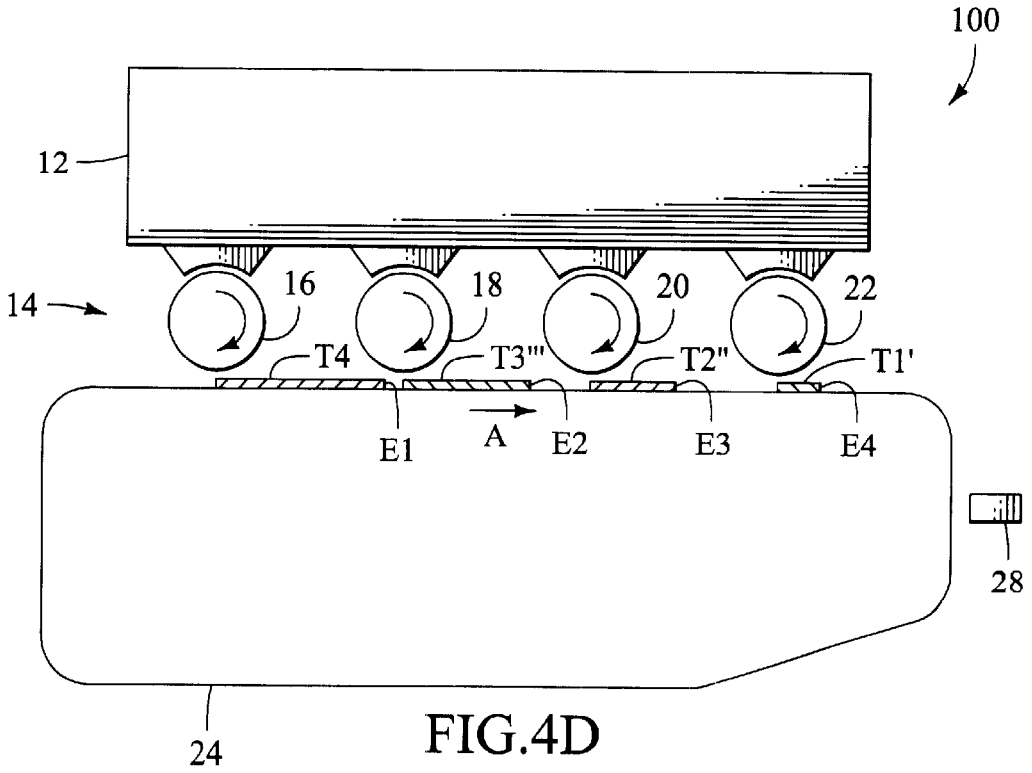
Figure 4E:
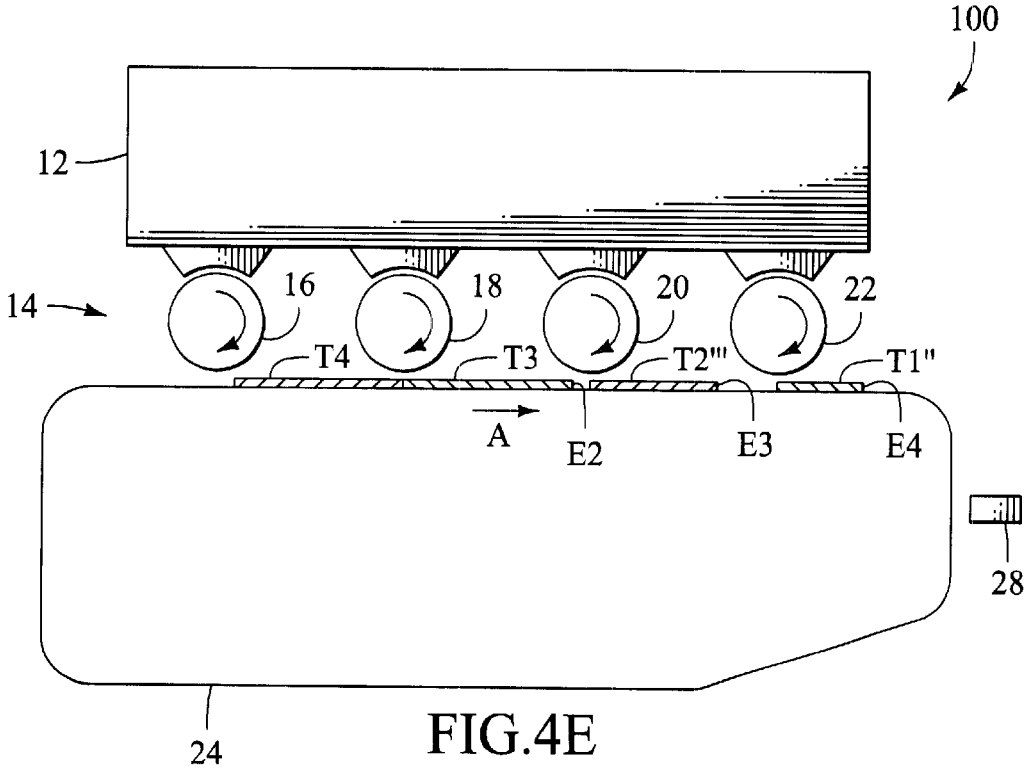

FIG. 4D depicts the next stage in the calibration image product generation process of the present embodiment. In this figure, the deposition of toner T4 to the transfer medium 24 has been completed, and the deposition of toner T1 begun, and a partial path T1' is already completed. At this point, toners T3, T2 and T1 are all being applied simultaneously. Toner T2 has been deposited on the transfer medium 24 for a partial path length of T2", and toner T3 has been deposited for a partial path length of T3"'. Moving to FIG. 4E, we see that the deposition of toner T3 as well as toner T4 has now been completed, and toners T2 and T1 are still being applied simultaneously. Toner T2 will continue to be applied to the transfer medium to fill the gap between toner partial path T2"Δ and the leading edge of toner T3, and toner T4 will continue to be applied to the transfer medium to fill the gap between toner partial path T1" and the leading edge of toner T2.

Figure 4F:
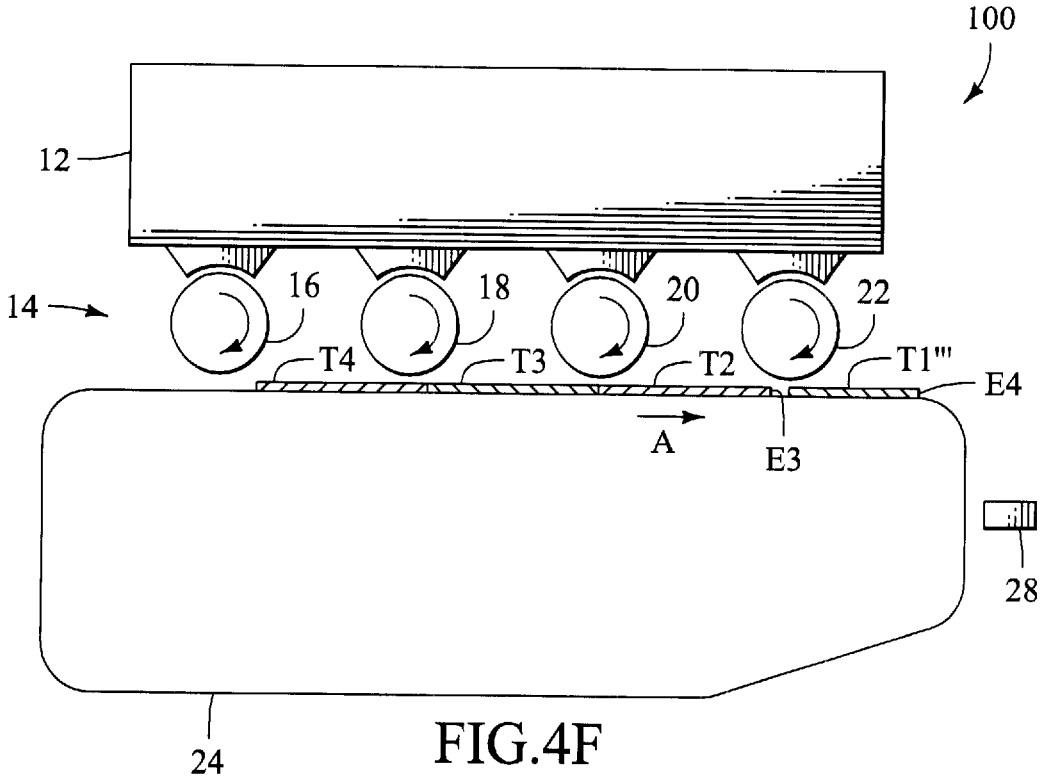
Figure 4G:
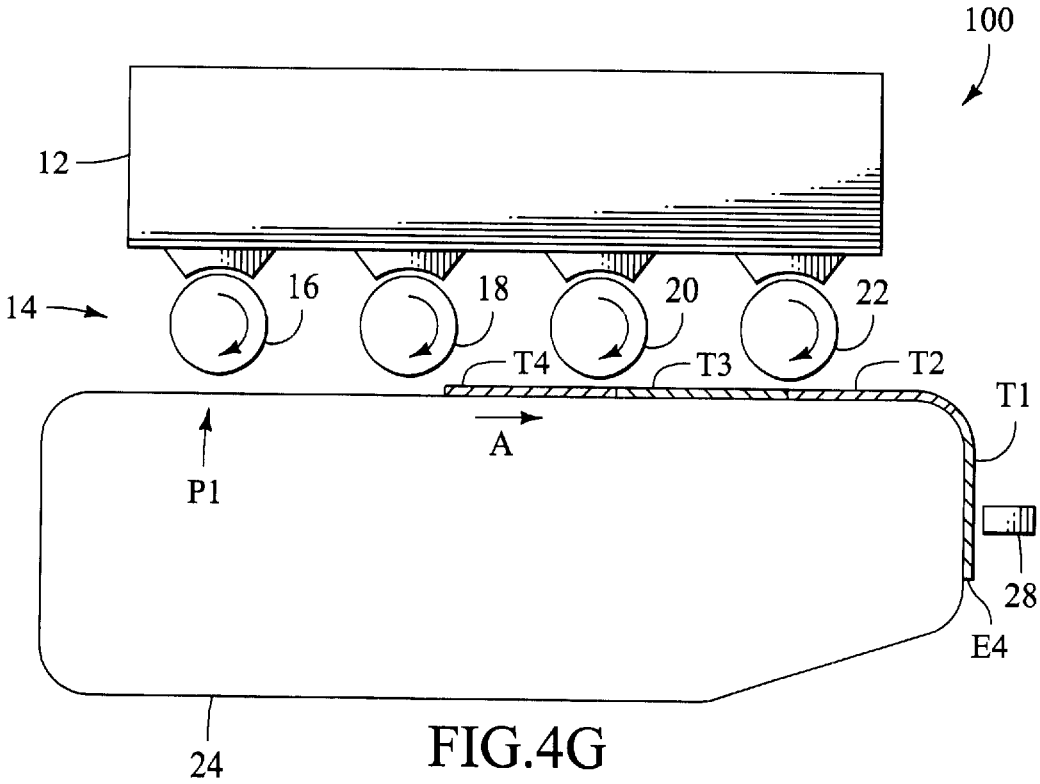

In FIG. 4F, the application of the calibration image product to the transfer medium 24 is nearly complete, and only toner T1 is being applied to the transfer medium to complete the partial toner path T1"'. Finally, in FIG. 4G we see the completed calibration image product consisting of toners T1 through T4. As can be seen from FIG. 4G, the total time between the initiation of the process and the time the leading edge E4 of the first toner (T1) reaches the calibration sensor 28 is the time it took for the leading edge E1 of toner T4 to move from point P1 to the point shown in the figure. This is obviously a shorter time period than the prior art, wherein the sensing process cannot begin until edge E1 of toner T4 has moved from point P1 to the calibration sensor 28.

The embodiments depicts in FIGS. 3A through 3E, and FIGS. 4A through 4G, are simplified in that: (1) the toner paths in each embodiment are all of equal length; (2) the distances between the toner stations are all of equal length; (3) there are no gaps between toner paths; and (4) no toners are overlaid one over the other. However, the present invention can accommodate all of these situations. As a starting point, we first recall the general principles described above with respect to the two embodiments. That is, where a toner path is longer than the distance between the respective toner station and the next adjacent station (in a direction away from the calibration sensor), then the application of the toner is begun before the application of the next adjacent toner is begun. This allows the toner path to be "stretched out". Contrariwise, where a toner path is shorter than the distance between the respective toner station and the next adjacent station (in a direction away from the calibration sensor), then the application of the toner is begun after the application of the next adjacent toner is begun. This allows the toner path to be "compressed". These general principles can be applied to situations where the toner path lengths vary, and where the distances between toner stations vary.

Figure 5:
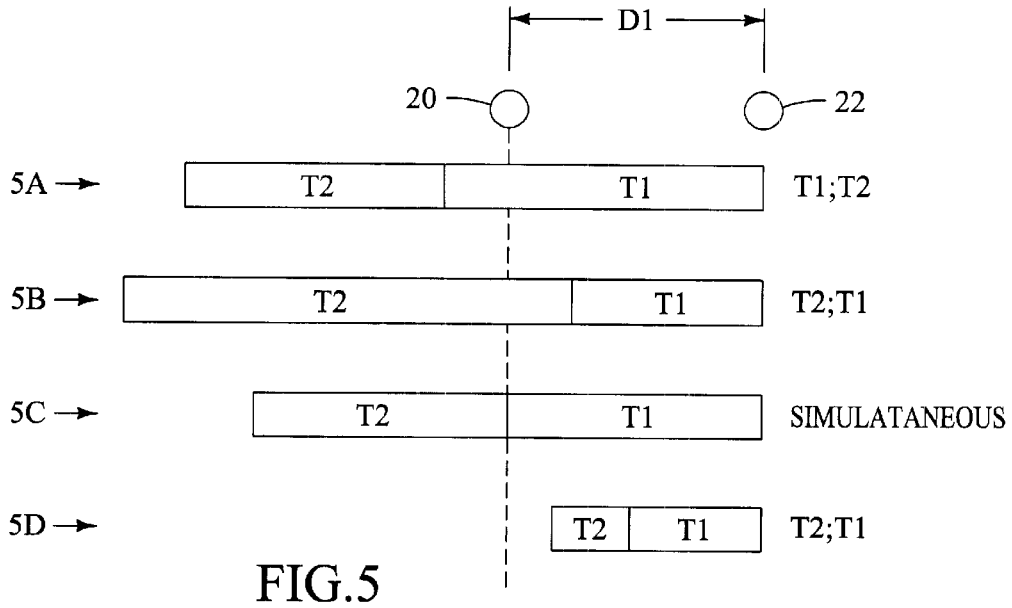
FIG. 5 is a schematic diagram depicting four variations of how first and second toners can be applied to a transfer belt in the calibration methods of the present invention.

This concept is illustrated in FIG. 5, which shows a variety of toner path length scenarios for a two toner imaging process. Two toner stations, toner station 20 and adjacent toner station 22, are shown in simplified form. Various toner path lengths for the respective toners T1 and T2 are also shown. The toner paths are shown shifted to the right to align the total combined toner path with toner station 22. This shift of the toner paths in the figure will facilitate comprehension of the logic used to determine which of the two toners is to be initially applied first. In FIG. 5A, toner path T1 is longer than the distance D1 between toner stations. Accordingly, the application of toner T1 will need to begin first, and then toner T2. Importantly, before toner T2 can be applied, toner T1 is applied for a distance equal to the distance between toner station 20 and the leading edge of toner T2. This leaves a "gap" for toner T1 to later fill as the transfer medium moves the intended toner paths past the toner stations. It should also be noted that the length of toner path T2 has no affect of the timing sequence in this scenario.

In FIG. 5B, the path of toner T1 is shorter than the distance D1 between toner stations 22 and 20. Accordingly, the application of toner T2 will begin before the application of toner T1 so that a gap is not left between toners after toner T1 has been applied. As is apparent, toner T2 is applied for a distance equal to the distance between the toner interface and toner station 20 before toner T1 is applied. In FIG. 5C wherein the path of toner T1 is equal to the distance D1 between toner stations, the deposition of the two toners can begin simultaneously. If the scenario shown in FIG. 5C is applied to a four-toner process similar to that depicted in FIG. 3A, then the application of all four toners can begin simultaneously. Again, it is noted that the length of the last toner path (i.e, the toner farthest from the calibration sensor) is irrelevant, since it is not constrained by a distance between the toner station 20 and an adjacent toner station.

In the scenario depicted in FIG. 5D, the combined path length of toners T1 and T2 are shorter than the distance D1 between toner stations. In this scenario toner T2 must obviously be applied first in its entirety before toner T1 is applied.

Figure 6:
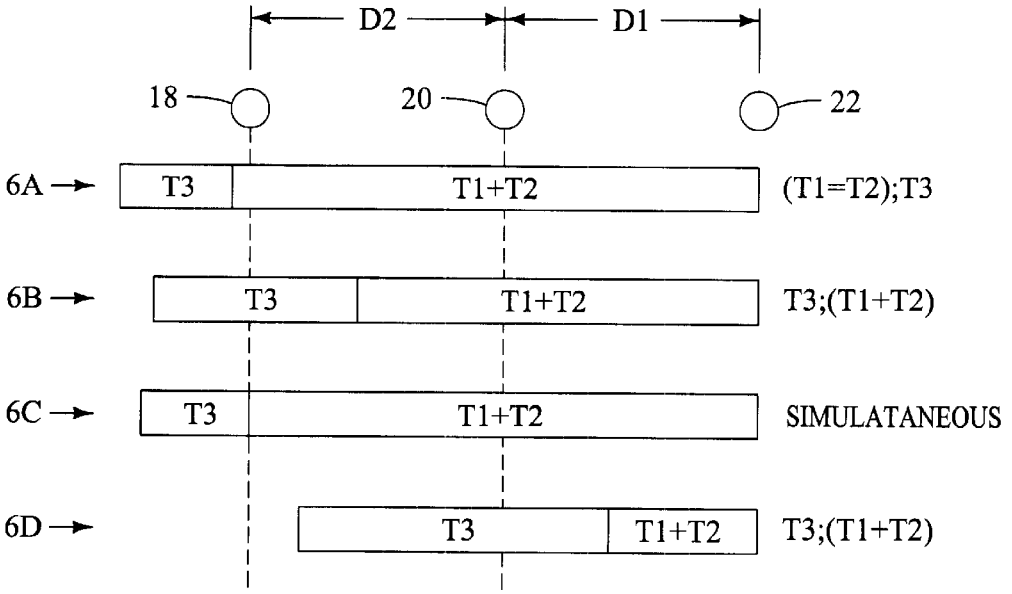
FIG. 6 is a schematic diagram depicting four variations of how a third toner can be applied to a transfer belt in the calibration product generation methods of the present invention.

The scenarios of FIG. 5 depict a simple two-toner process. When a third toner is added, as depicted in FIG. 6, the process of identifying the deposition initiation order of toners can be simplified by considering the combined path lengths of the first two toners as a single toner path length, (T1+T2). Likewise, the "distance between toner stations" for combined toner path length (T1+T2) is (D1+D2), the total distance between toner stations 22, 20 and 18. FIGS. 6A through 6D should be compared with their respective figures in FIG. 5. As with FIG. 5A, the order of toner deposition in FIG. 6A begins with the toner combination (T1, T2), and then toner T3. In FIG. 6B, the deposition of toner T3 begins first, and then the (T1, T2) toner combination. In FIG. 6C where the combined toner path (T1+T2) terminates at toner station 18, the depositions of T3 and the (T1, T2) combination can begin simultaneously. Finally, in the scenario shown in FIG. 6D, toner T3 will need to be applied in its entirety before applying the toner combination (T1, T2).

Accordingly, in a three toner imaging apparatus, the order of the toner T3 and the combination (T1, T3) can be determined first, and then the order of the toners T1 and T2 can be determined. For example, in a scenario where toners T3 and (T1, T2) are to be deposited as shown in FIGS. 6A, and toners T1 and T2 are to be applied as shown in FIG. 5B, the initial application of toner T3 would begin first, followed by the initial application of toner T2, and then toner T1. This same concept can be applied for an imaging device having four toners, by first determining the sequence for the fourth toner T4 and the toner combination (T1, T2 and T3). Then the order for toner T3 and the combination (T1, T2) is determined, and finally the order for toners T1 and T2 is determined. As can be seen, the process set forth herein for determining the sequence for initial toner deposition works "forward" toner by toner, starting with the toner most distal from the calibration sensor, and working forward towards the calibration sensor. In each step the path length of the toner under consideration is evaluated with respect to the overall path length of all of the other toners forward of the toner under consideration. Alternately, the order of the two toners nearest the calibration sensor can be determined first and saved, then the order for the next toner and the first subgroup determined, and so on until the sequence for the last toner (i.e., the toner station most distal from the calibration sensor) is determined.

As described with respect to FIG. 5, in addition to determining the order in which toner deposition initiation is to be performed, the length of time between toner deposition initiation of the various toners should also be determined. This process was described above for the two-toner embodiment of FIG. 5, and the same principles apply where there are more toners. For example, in a three-toner scenario comprising FIGS. 6A and 5A, the first toner to be applied will be from the group (T1, T2). The identified toner (T1 or T2) will be initially deposited onto the transfer medium first during the period it takes the transfer medium to move the distance from toner station 18 to the T3/(T1,T2) interface point (see FIG. 6A). During this period, deposition of toner T1 begins first and continues for the time it takes the transfer medium to move from toner station 20 to the T1/T2 toner interface point (see FIG. 5A). Then deposition of toner T2 begins and continues until the transfer medium has moved the T3/(T1, T2) interface point into alignment with toner station 18 (see FIG. 6A). Curing this latter time period, toners T1 and T2 are being applied simultaneously. Following this period, application of toner T3 begins, and all three toners are being applied simultaneously. Application of any given toner ceases when the predetermined toner path has been applied in its entirety.

Figure 7:
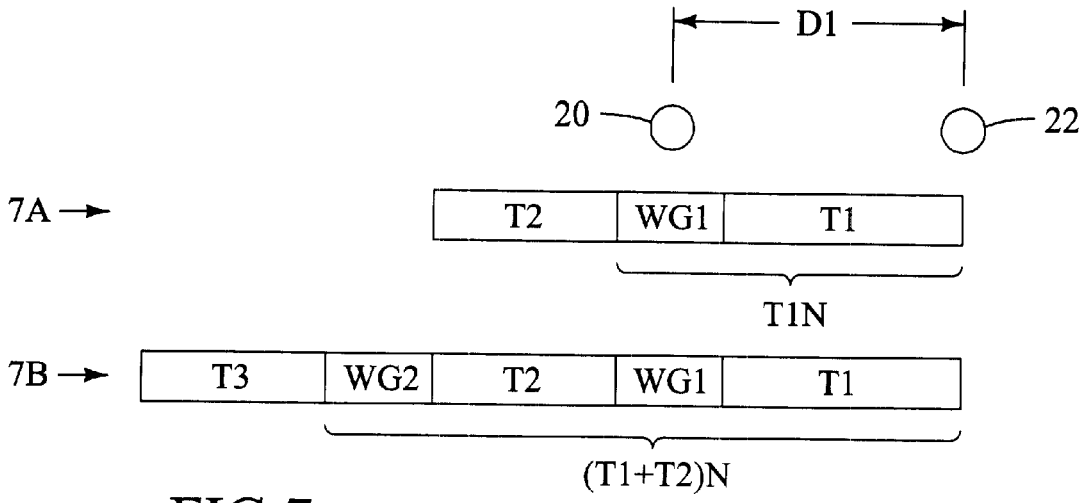
FIG. 7 is a schematic diagram showing how gaps can be disposed between toners in the calibration product generation methods of the present invention.

In the scenario where a gap (a "white gap") is prescribed between toner paths by the calibration image, this can be accommodated by considering a nominal toner path as being equal to the toner path itself plus the white gap ("WG"). This is illustrated in FIG. 7, which shows a first scenario where a white gap WG1 is to be disposed between toners T1 and T2. In this instance, the order of deposition initialization is determined by considering the first toner path as the nominal path T1N, consisting of path T1 plus the white gap WG1. Thereafter, the process described with respect to FIG. 5 can be applied to determine the deposition sequence. Likewise, in determining the deposition sequence for a three-toner imaging device, the white gaps following the first two toners T1 and T2 should be added to the (T1, T2) group, as shown in FIG. 7B, to produce a nominal subgroup (T1+T2)N. Thereafter the processes described with respect to FIGS. 5 and 6 can be applied to determine the deposition sequence.

Figure 9:
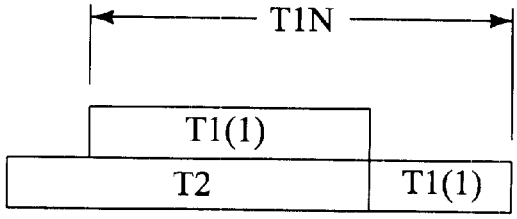
FIG 9 is a schematic diagram showing how one toner can be overlaid onto another toner in the calibration product generation methods of the present invention.

Likewise, where one toner is to be overlaid on top of another toner, the path length of the overlaid toner should be considered as being the combination of the non-overlaid portion and the overlaid portion. This is illustrated in FIG. 9 wherein toner T1 is deposited on the transfer medium separately for a path length of T1(1), and then is overlaid over toner T2 for a path length of T1(2). The nominal path length of toner T1 for purposes of determining deposition initiation sequence is the path T1N=(T1(1)+T1(2)). Thereafter, the above described processes shown in FIGS. 5 and 6 and described above can be employed to determine the order of deposition of toner T2 and any other toners. In this manner additional colors and color tones and densities can be produced for calibration purposes using the methods and apparatus of the present invention.

Figure 10:
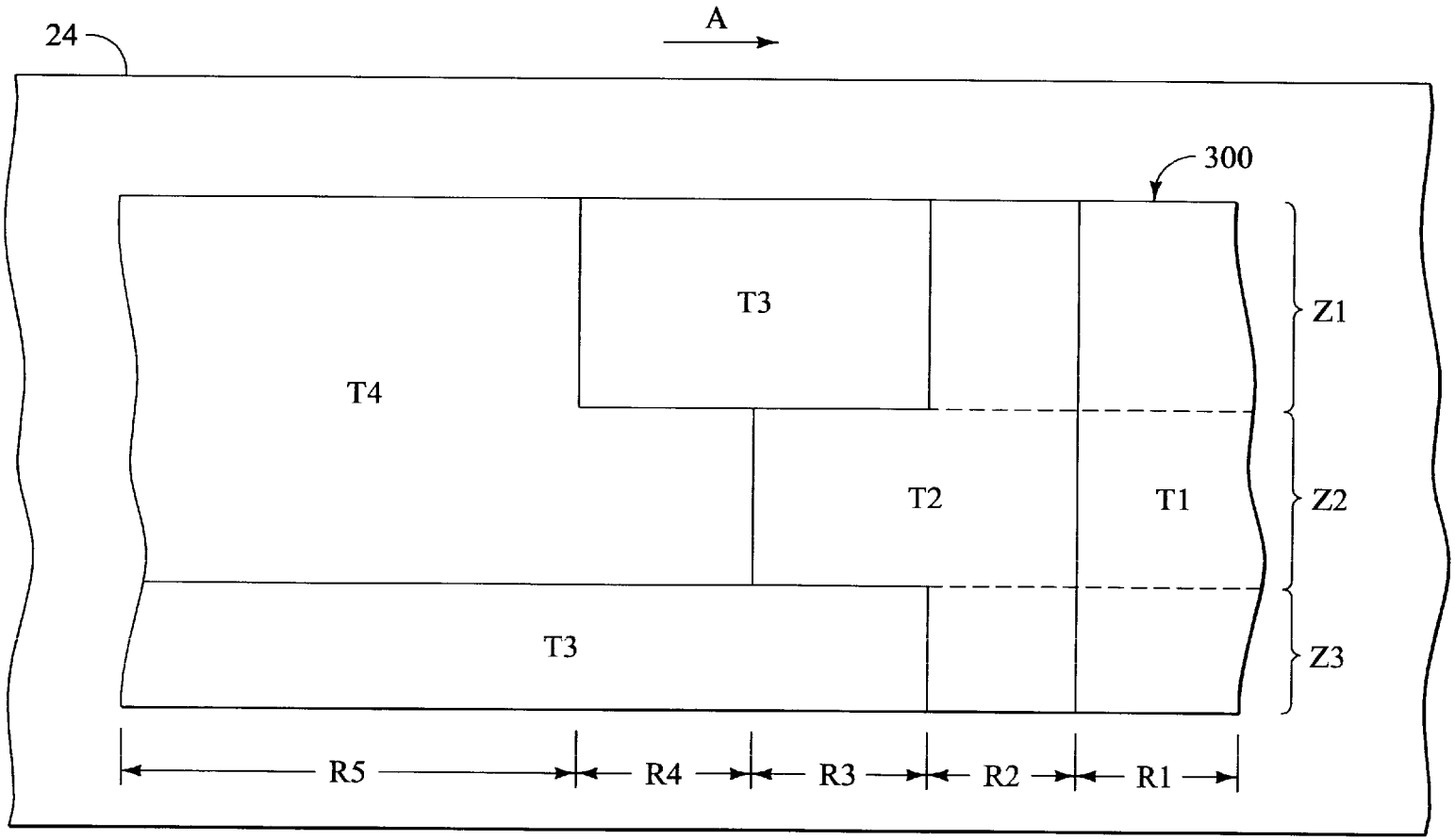
FIG. 10 is a plan view of a partial calibration product depicting how pattern variations across a transfer medium can be accommodated in the calibration product generation methods of the present invention.

While the calibration image product generation process has thus far been depicted as comprising a serial deposition of toners in a continuous horizontal path on the transfer medium in the direction of travel "A" (see for example FIG. 3E), it is understood that there can be variances in the calibration image product in a direction across the transfer medium, i.e., perpendicular to the direction of travel. For example, turning to FIG. 10, a plan view of a partial calibration product image 300 deposited on a transfer medium 24 moving in direction "A"is depicted. The calibration image pattern comprises a first region R1 of only toner T1, a second region R2 of only toner T2, a third region R3 of toners T2 and T3, a fourth region R4 of toners T3 and T4, and a fifth region R5 of toners T3 and T4. The methods of the present invention can be applied to this calibration image pattern by breaking the image up into zones which allow serial deposition of toners as described above. For example, as shown in FIG. 10 a first zone Z1 consists of serial toners T1, T2, T3 and T4; a second zone Z2 consists of serial toners T1, T2 and T4; and a third zone Z3 consists of serial toners T1, T2 and T3. Once the serial zones have been defined, the above described processes can be used for each zone to determine the order for deposition of toner for that zone.

Since imaging devices are typically configured to generate patterns on a pixel-by-pixel basis, complex geometries such as circles and the like can be imaged, as well as simple patterns like that depicted in FIG. 10. Accordingly, where the calibration image is a complex pattern, the defined "zones" can each be reduced to the width of a single pixel. If for example the calibration pattern is 4800 pixels wide, then 4800 separate zones of serial toner deposition would be established. Each region can thus be analyzed in accordance with the invention described above to determine the deposition initiation order and sequence for each region. Obviously, identical zones, or zones sharing identical portions, can be represented by reference to a common stored sequence for that zone or region.

While we have just described how complex calibration patterns can be accommodated within the scope of the present invention, another aspect of the present invention is to provide a calibration image which allows for reduced calibration image product generation time and reduced overall calibration time. For example, returning to FIGS. 3A through 3E, it is apparent that a calibration image consisting of only the four toners of path lengths greater than the distance between the toner stations will allow the calibration process to begin in a very short time since the leading edge E1 of the first toner T1 reaches the calibration sensor 28 in a relatively very short time. On the other hand, the calibration product produced by the method depicted in FIGS. 4A through 4G will result in a very short overall calibration process, since the overall calibration image product is shorter than the calibration product generated by the method depicted in FIGS. 3A through 3E. In yet another embodiment previously described, all four toner paths can be equal in length and equal to the distances between toner stations, thus allowing simultaneous deposition of all toners for the duration of the entire calibration product generation process. The most efficient calibration image pattern to be used in the methods and apparatus of the present invention will depend on a number of factors, including the number of toners, the spacing between toner stations, the transport speed of the transfer medium, and the complexity of the calibration pattern required to achieve acceptable calibration of the imaging device.

Since the same calibration image is typically used each time calibration of the imaging device is performed, there is no need to redetermine the sequence for generating the calibration product each time the calibration process is performed. Once the algorithm for generating the calibration product is established the first time, it can be stored in computer readable memory and executed each time the calibration process is performed.

Figure 11:
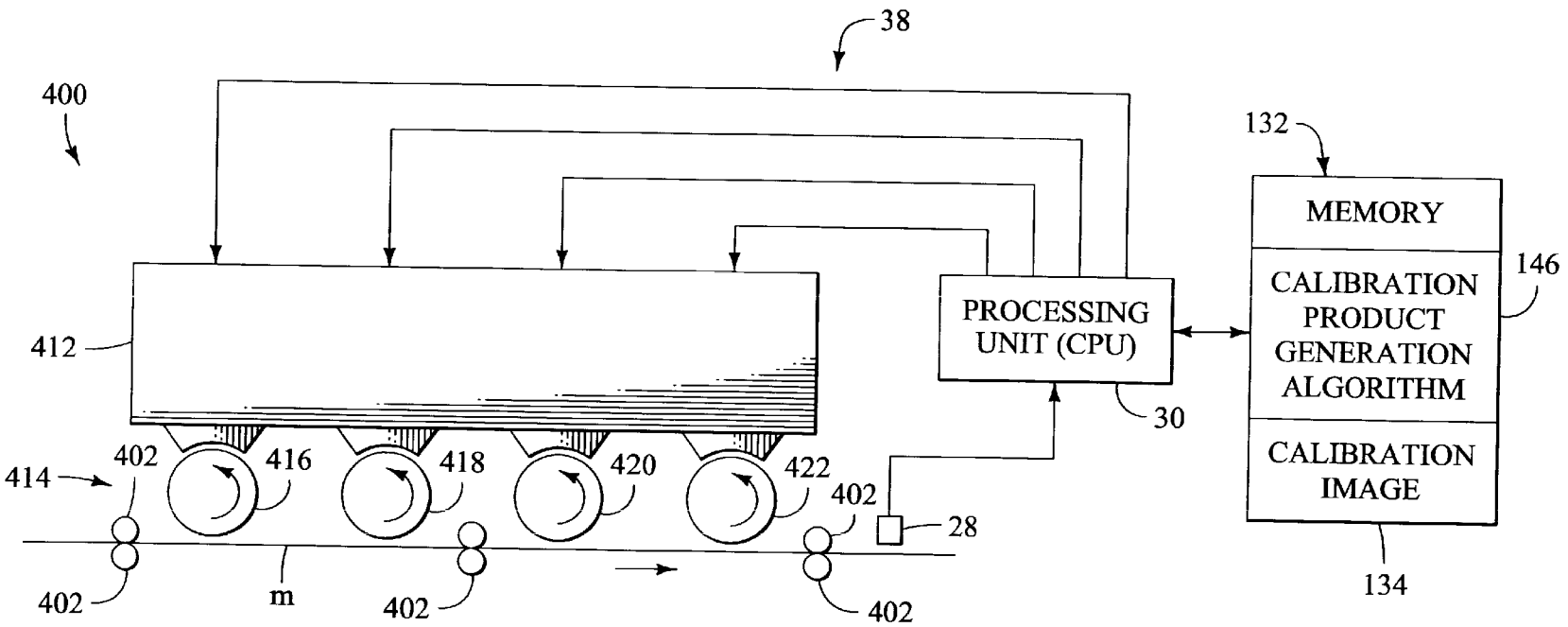
FIG. 11 is a side elevation schematic of an alternate imaging device having a calibration image product generating algorithm in accordance with the present invention.

With reference to FIG. 11, an alternative embodiment of an imaging apparatus 400 which can implement the calibration product generation methods of the present invention is depicted. The imaging apparatus 400 is similar to the apparatus 100 of FIG. 1B, except that the transfer medium 24 of FIG. 1B is eliminated, along with the accompanying rollers 26 and cleaning station 40. In place of the transfer medium 24 of FIG. 1B, a sheet of final image medium "m", such as a piece of paper, is used. In the imaging apparatus 400 of FIG. 11 the final image medium "m", which is supported by rollers 402, is passed directly by the toner stations 416, 418, 420 and 422. Toner from the toner stations can then be deposited directly onto the final image medium "m" in accordance with the methods disclosed above. The final image medium "m" also passes by the calibration sensor 28 after passing the last toner station 422. In this manner, the calibration sensor 28 can begin detecting the calibration image product on the final image medium "m" while toner is still being applied by the toner stations 416, 418, 420 and 422 onto the image medium "m".

Figure 8A:
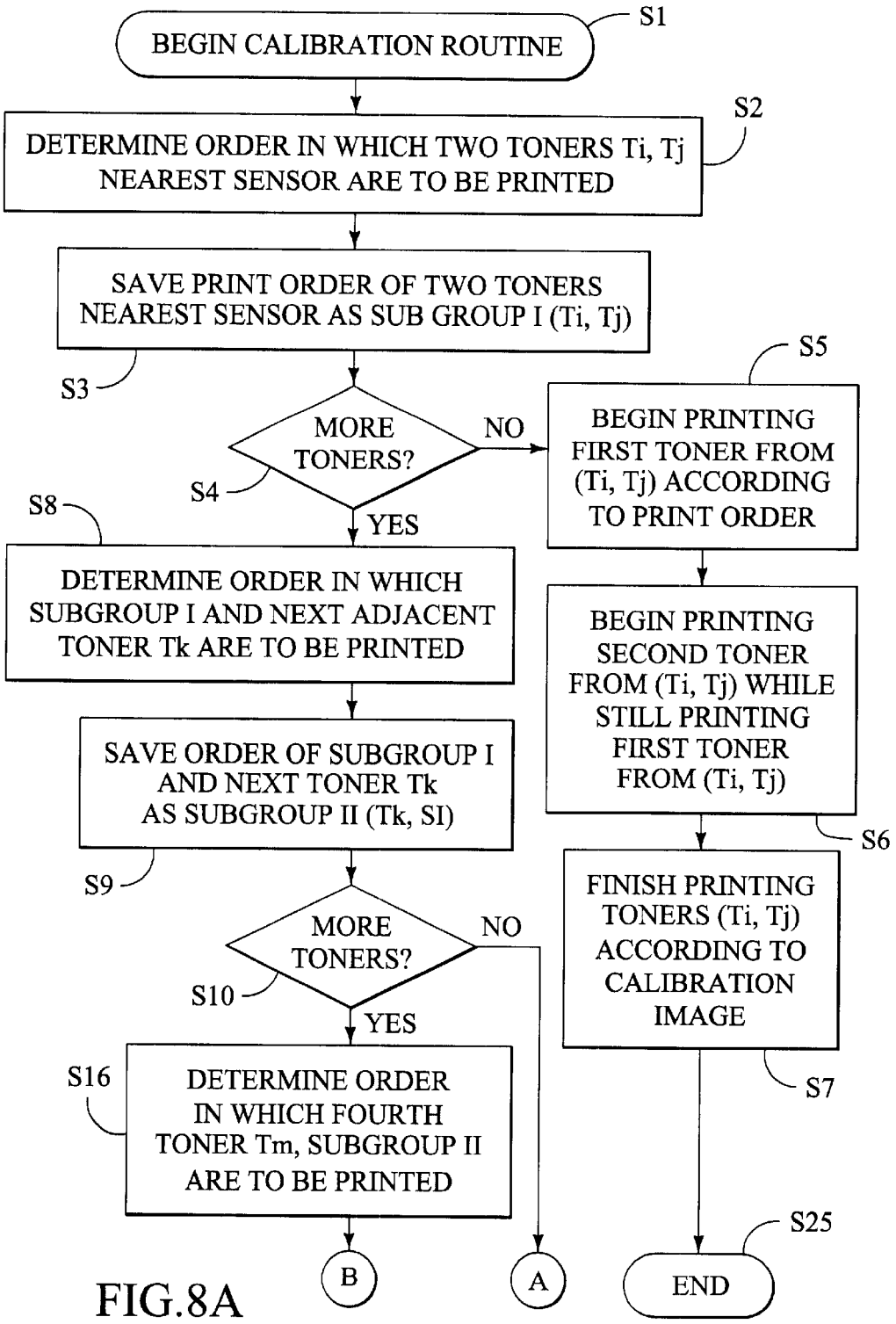
FIGS. 8A through 8C comprise a flow chart showing one method of the present invention as used for an imaging devices having up to four different toners.
Figure 8B:
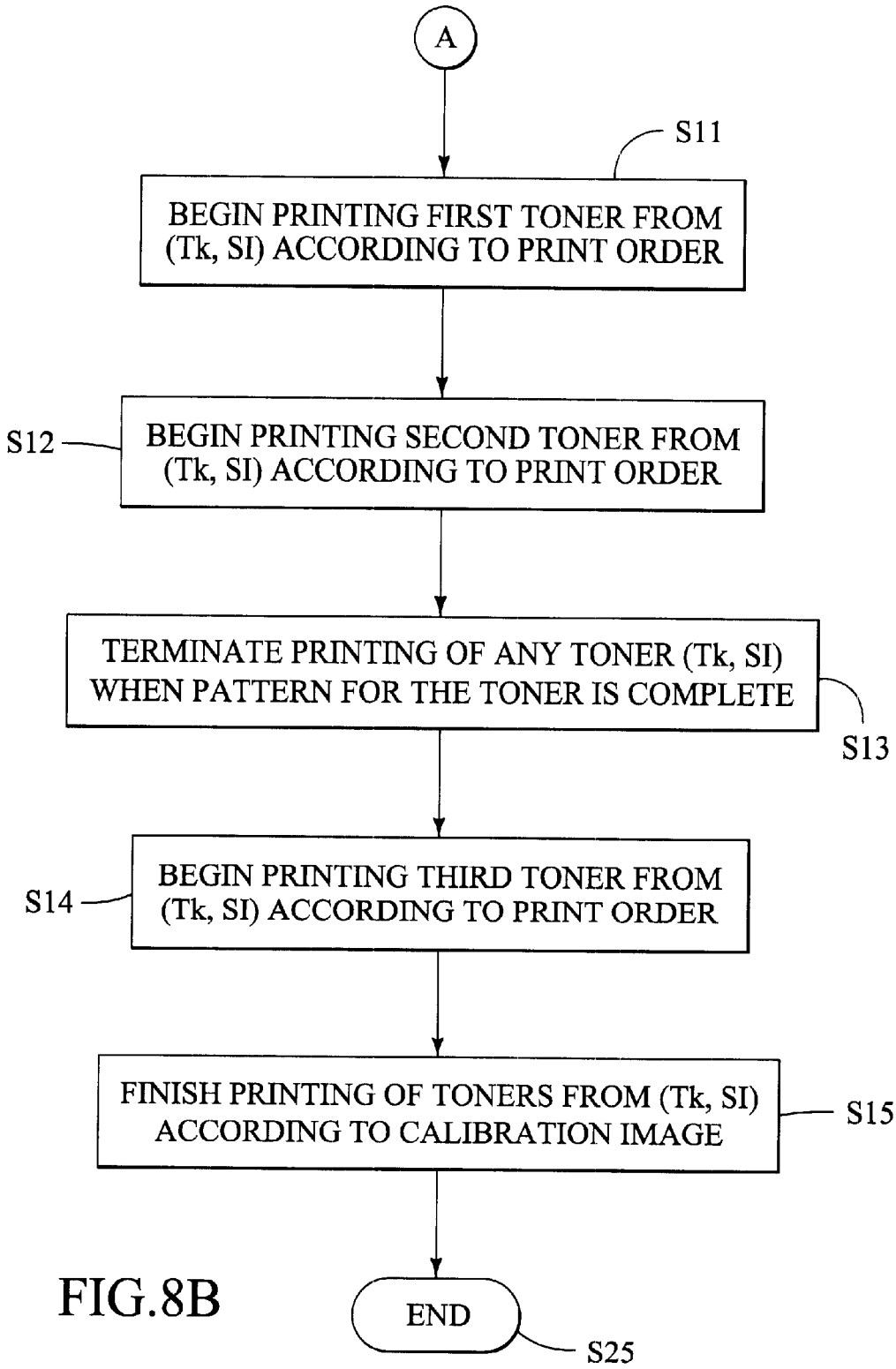
Figure 8C:
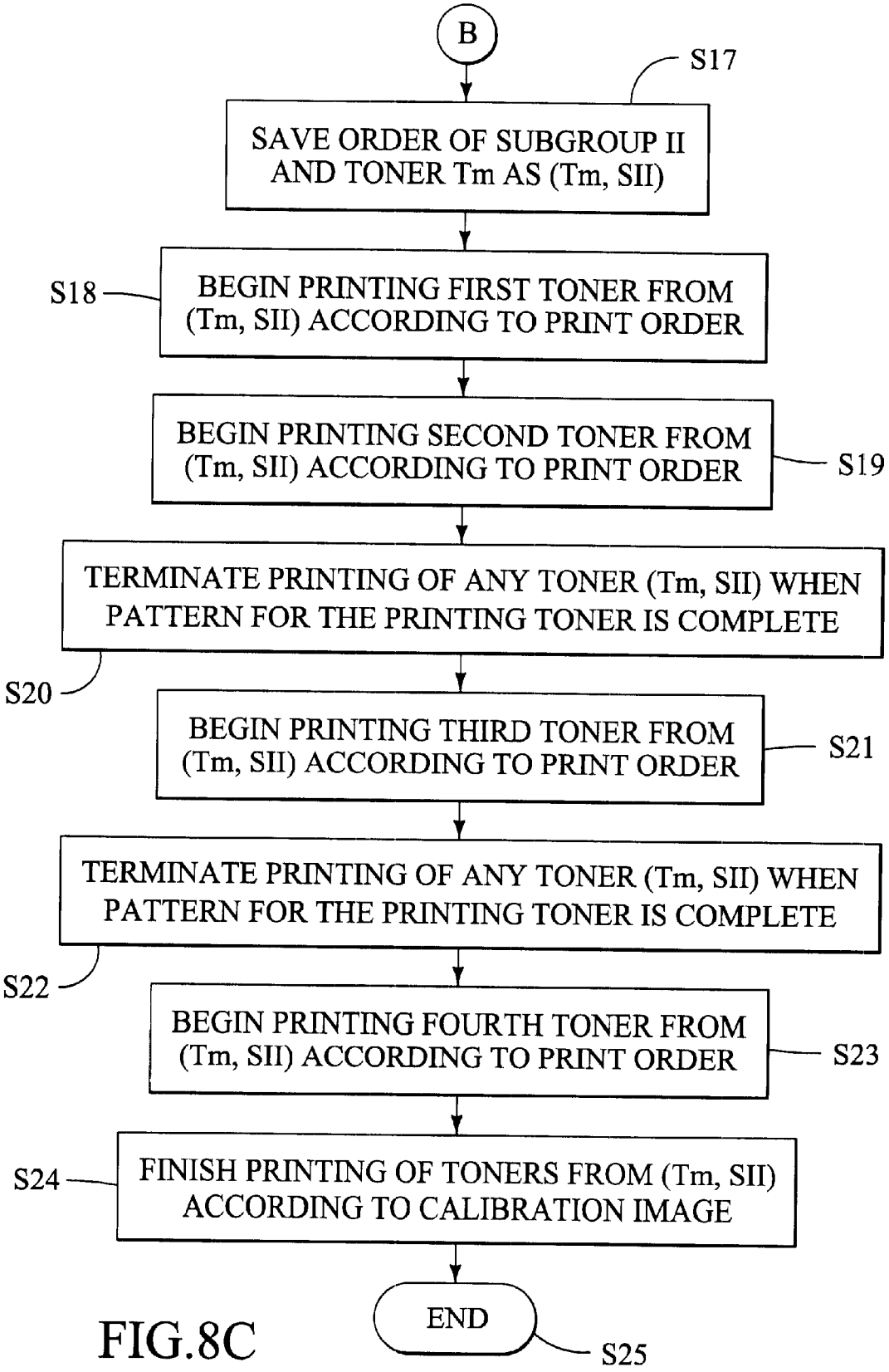

Turning now to FIGS. 8A through 8C, a flowchart is depicted showing one embodiment of performing a method of the present invention. The flowchart assumes an imaging device having up to four toners is being calibrated. While certain of the steps are described as "determining the order" in which the toners are to be deposited on the transfer medium, as just described these steps can be replaced with the step of recalling the previously defined order from computer readable memory. Accordingly, the flowchart more properly describes the method of generating the algorithm for generating the calibration product a first time. Thereafter, the calibration product generation process is more a process of recalling and executing the previously determined sequence of toner depositions.

The first step S1 in the process shown in FIG. 8A is to initialize the calibration routine. At step S2 the order in which the first two toners T1 and Tj nearest the calibration sensor (28 of FIG. 1B) are to be deposited on the transfer medium 24 is determined. One method for doing this is shown in FIG. 5 and described above. The result is saved in computer readable memory as Subgroup I at Step S2. At step S2 the process queries whether there are additional toners to be deposited to generate the calibration product. If not, the process continues to step S5 where the process of depositing (i.e., "printing") the first determined toner onto the transfer medium begins. Once a sufficient path of the first determined toner has been deposited to allow the second toner to be deposited without interference, the process moves to step S6 where deposition of the second toner begins. Although step S6 states that toners Ti and Tj are deposited simultaneously at this stage, it is possible that the first toner can be completely deposited before the second toner begins to be deposited. Such a scenario is depicted in FIG. 5D. At step S7, the process completes the printing (depositing) of the two toners according to the calibration image, and moves to step S25 to terminate the calibration product generation process. It is understood that at this point the actual calibration process can then be performed.

Returning to step S4, where a third toner is to be incorporated as part of the calibration product, the process moves to step S8 to determine the order in which the third toner Tk is to be printed relative to the order of Subgroup I (consisting of toners Ti and Tj). One method for making this determination was described above and with respect to FIG. 6. The resulting sequence for printing the toner group (Tk, SI) is saved as Subgroup II at step S9. It should be appreciated than another manner of identifying the group (Tk, SI) ib with the nomenclature (Tk, (Ti, Tj)). At step S10 the program queries whether there are additional toners to be used to generate the calibration product. If not, the process proceeds to step S11 on FIG. 8B (see connector "A") to begin the printing or deposition of the three toners, where the printing of the first determined toner from the group (Tk, (Ti, Tj)) begins. At step S12 the printing of the second determined toner from this group begins. The printing of the first and second determined toners is preferably performed simultaneously at this point. At step S13 the printing of any of the first or second determined toners is terminated where the calibration pattern for the toner is completed. If no pattern is completed, no toner deposition is terminated. Then at step S14 the deposition of the third determined toner from the group (Tk, (Ti, Tj)) is initiated. At this point all three toners can be deposited simultaneously on the transfer medium. Proceeding to step S15 the printing of any toners not terminated at step S13 is completed and the printing terminated. The process then ends at step S25.

It should be understood that the initiation of the deposition process at steps S12 and S14 for the second and third determined toners is calculated according to the length of the respective toner path and the distance between toner stations in the method described above with respect to FIGS. 5 and 6.

Where a fourth toner Tm is to be used to generate the calibration product, at step S10 on FIG. 8A the process then moves to step S16 to determine the order in which the fourth toner will be printed relative to the second subgroup SII, so that a sequence (Tm, SII) for the collective toner deposition order, can be determined. This sequence can also be written as (Tm, (Tk, (SI))), or (Tm, Tk, Ti, Tj). It is understood that this nomenclature is not representative of the actual order in which the toners are printed, but only of the toners included in the sequence. This sequence is preferably saved in computer memory at step S17 shown on FIG. 8C (see connector "B") so that it can be recalled and executed in the subsequent calibration product generation process. At step S18 the deposition of the first determined toner in the group (Tm, SII) is initiated, followed by the initiation of the second determined toner at step S19. At step S20 the process checks to determine whether the calibration pattern allows the printing of either of the two toners to be terminated. If so, the deposition is terminated for that toner. Then at step S21 the deposition of the third determined toner begins in accordance with the print order previously determined. At this step, all three toners can be simultaneously deposited on the transfer medium if the toner path lengths and toner station spacing so provide. An example of this is depicted in FIG. 3C. In step S22 the process checks to determine whether the calibration pattern allows the printing of any of the currently printing toners to be terminated. If so, the deposition is terminated for that toner, and the process proceeds to step S23 where the printing of the fourth determined toner is initiated. An example of this is depicted in FIG. 3D. The method for calculating the timing for initializing the deposition of the various toners is described above and with respect to FIGS. 5 and 6. Finally, at step S24 the printing of any still-printing the various toners is terminated as they complete the calibration product, and the calibration product generation process is terminated at step S25.

While the above invention has been described in language more or less specific as to structural and methodical features, it is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method for generating a calibration product for an image producing device, the image producing device having a plurality of toner stations and a transfer medium, each toner station being configured to deposit an associated toner onto the transfer medium to thereby generate the calibration product, comprising:

depositing a first toner from a first toner station onto the transfer medium while moving the transfer medium from a first position relative to the plurality of toner stations to a second position;

depositing a second toner from a second toner station onto the transfer medium while continuing to deposit the first toner onto the transfer medium while moving the transfer medium from the second position to a third position; and selecting the first toner to be applied to the transfer medium as a function of a length of a portion of the calibration product to be defined by the first toner and the distance between the first toner station and the second toner station.

2. The method of claim 1, and further comprising selecting the third toner to be applied to the transfer medium as a function of a length of a portion of the calibration product to be defined by the first and second toners and the distance between the first toner station and the second toner station, and the second toner station and the third toner station.

3. A method for generating a calibration product for an image producing device, the image producing device having a plurality of toner stations and a transfer medium, each toner station being configured to deposit an associated toner onto the transfer medium to thereby generate the calibration product, comprising:

depositing a first toner from a first toner station onto the transfer medium while moving the transfer medium from a first position relative to the plurality of toner stations to a second position;

depositing a second toner from a second toner station onto the transfer medium while continuing to deposit the first toner onto the transfer medium while moving the transfer medium from the second position to a third position, and wherein:

the image producing device has a calibration sensor past which the calibration product is moved on the transfer medium, and the first toner deposited on the transfer medium is from a toner station located nearer to the calibration sensor than any of the other toner stations.

4. A method for generating a calibration product for an image producing device, the image producing device having a plurality of toner stations and a transfer medium, each toner station being configured to deposit an associated toner onto the transfer medium to thereby generate the calibration product, comprising:

simultaneously depositing a first toner from a first toner station and a second toner from a second toner station onto the transfer medium while moving the transfer medium from a first position relative to the plurality of toner stations to a second position;

simultaneously depositing a third toner from a third toner station onto the transfer medium while moving the transfer medium from the first position relative to the plurality of toner stations to the second position;

ceasing to deposit at least one of the first or second toners onto the transfer medium while continuing to deposit the third toner and while moving the transfer medium from the second position to a third position relative to the plurality of toner stations; and wherein:

the calibration image product is defined by portions of given lengths of each deposited toner, and the toner stations define distances there between, the method further comprising determining a timing sequence for individual and simultaneous application of the toners onto the transfer medium as a function of the distances between the toner stations, and the lengths of the portions of each toner to be deposited on the transfer medium.

5. A method for generating a calibration product for an image producing device, the image producing device having a plurality of toner stations and a transfer medium, each toner station being configured to deposit an associated toner onto the transfer medium to thereby generate the calibration product, comprising:

simultaneously depositing a first toner from a first toner station and a second toner from a second toner station onto the transfer medium while moving the transfer medium from a first position relative to the plurality of toner stations to a second position, and wherein:

the image producing device further includes a calibration sensor configured to detect the calibration product, and further comprising providing a digitized calibration image to generate the calibration product, and further wherein the digitized calibration image is configured to minimized the time between the depositing of the first toner and a subsequent time when the calibration product is first detected by the calibration sensor.

6. A method for generating a calibration product for an image producing device, the image producing device having a plurality of toner stations and a transfer medium, each toner station being configured to deposit an associated toner onto the transfer medium to thereby generate the calibration product, comprising:

simultaneously depositing a first toner from a first toner station and a second toner from a second toner station onto the transfer medium while moving the transfer medium from a first position relative to the plurality of toner stations to a second position; and wherein:

the calibration product defines a first region comprising the first toner and defined by a first length, and a second region comprising the second toner, and further wherein the first and second toner stations are separated by a first distance which is greater than the first length, the method further comprising depositing a portion of the second toner on the transfer medium prior to depositing any of the first toner on the transfer medium.

7. An image producing apparatus comprising:

a scanning section;

a plurality of toner stations;

a transfer medium;

a calibration image product generator; and wherein each toner station is configured to deposit a dedicated toner onto the transfer medium, the transfer medium is configured to move past the toner stations in serial order, the scanning section is configured to cause selective deposition of toner associated with a toner station onto the transfer medium, and the calibration image product generator is configured to cause the scanning section and the plurality of toner stations to produce a calibration image product on the transfer medium as the transfer medium moves past the toner stations, and further wherein the calibration image product generator is configured to cause at least two toner stations to simultaneously deposit toner onto the transfer medium.

8. The image producing apparatus of claim 7, and further comprising a processor in signal communication with the scanning section, and a computer readable memory accessible by the processor, and wherein the calibration image product generator comprises a series of computer executable steps stored in the computer readable memory.

9. The image producing apparatus of claim 8, and wherein the calibration image product generator further comprises a digitized calibration image to be reproduced as the calibration image product, and wherein the digitized calibration image is configured to cause the at least two toner stations to simultaneously deposit toner onto the transfer medium.

10. The image producing apparatus of claim 9, and wherein the digitized calibration image is configured to cause the at least three toner stations to simultaneously deposit toner onto the transfer medium.

11. The image producing apparatus of claim 8, and wherein the toner stations define distances between each toner station, and the calibration image product is defined by image portions of predetermined lengths of dedicated toners to be applied to the transfer medium, and further wherein the calibration image product generator further comprises an algorithm for determining the order of individual and simultaneous deposition of toners onto the transfer medium, and wherein the algorithm is a function of the distance between toner stations and the lengths of the image portions.

12. The image producing apparatus of claim 7, and wherein the transfer medium is a rotating belt.

13. The image producing apparatus of claim 7, and wherein the transfer medium is a rotating drum.

14. A method for generating a calibration product for an image producing device, the image producing device having a plurality of toner stations, each toner station being configured to deposit an associated toner onto a final image medium to thereby generate the calibration product, comprising:

simultaneously depositing a first toner from a first toner station and a second toner from a second toner station onto the final image medium while moving the final image medium from a first position relative to the plurality of toner stations to a second position; and passing the final image medium past a calibration sensor while continuing to deposit at least one of the first toner and the second toner onto the final image medium.

15. A method for generating a calibration product for an image producing device, the image producing device having a plurality of toner stations, each toner station being configured to deposit an associated toner onto a final image medium to thereby generate the calibration product, comprising:

simultaneously depositing a first toner from a first toner station and a second toner from a second toner station onto the final image medium while moving the final image medium from a first position relative to the plurality of toner stations to a second position; and depositing a third toner from a third toner station onto the final image medium while moving the final image medium from the second position to a third position relative to the plurality of toner stations, while simultaneously applying at least one of the first toner or the second toner onto the final image medium; and wherein:

the calibration image product is defined by portions of given lengths of each deposited toner, and the toner stations define distances there between, the method further comprising determining a timing sequence for individual application of the toners onto the final image medium as a function of the distances between the toner stations, and the lengths of the portions of each toner to be deposited onto the final image medium.

* * * * *